United States Patent [19]

Fredd et al.

[11] 4,033,408

[45] July 5, 1977

[54] GO-DEVIL STORAGE AND DISCHARGE ASSEMBLY

[75] Inventors: John V. Fredd, Dallas, Tex.; William G. Hill, Lake Charles, La.

[73] Assignee: Continental Oil Company, Ponca City, Okla.

[22] Filed: Mar. 18, 1976

[21] Appl. No.: 668,269

Related U.S. Application Data

[62] Division of Ser. No. 516,205, Oct. 21, 1974, Pat. No. 3,955,624.

[52] U.S. Cl. ..... 166/75 R; 166/72; 137/268

[51] Int. Cl.[2] ..... E21B 23/00; E21B 43/12

[58] Field of Search ..... 166/75, 153, 156, 315, 166/72; 15/104.06 A; 137/268

[56] References Cited

UNITED STATES PATENTS

| | | | |
|---|---|---|---|
| 2,976,928 | 3/1961 | Gilbert | 166/75 |
| 3,011,196 | 12/1961 | Glover | 15/104.06 A |
| 3,028,996 | 4/1962 | Ellett | 166/75 UX |
| 3,403,729 | 10/1968 | Hickey | 166/75 |
| 3,457,932 | 7/1969 | Wakefield, Jr. | 15/104.06 A X |
| 3,541,837 | 11/1970 | Davis et al. | 15/104.06 A X |
| 3,848,621 | 11/1974 | Dickenson | 15/104.06 A X |
| 3,889,708 | 6/1975 | Chronister et al. | 15/104.06 A X |

*Primary Examiner*—Stephen J. Novosad
*Attorney, Agent, or Firm*—H. Mathews Garland

[57] ABSTRACT

Well tools comprising a go-devil actuated well safety valve, a locking assembly for releasably locking the safety valve at a desired depth in a well, running and pulling tools for installing and removing the safety valve, a go-devil ball for closing the safety valve, and apparatus for dropping the go-devil ball in a well under pressure and for retrieving the ball. The go-devil safety valve is mounted above the locking assembly and includes a trigger type latch which is released from above by the impact of the go-devil ball. The valve may be reset for reopening the valve without removal of the valve from the well bore by means of a special reset and pulling tool disclosed herein. The go-devil valve is installed in a well, preferably above a storm choke, to shut the well in under emergency conditions which releases the go-devil ball at the surface in response to hazardous conditions such as fire. The go-devil ball drops to the go-devil valve which closes in response to the impact of the ball.

5 Claims, 30 Drawing Figures

323
320
323

320
315
320
321
323
323
322
322
320
600
601
602
603
605
604
613
610
612
614
611
620
622
621
634
630
631
633
625
632
642
624
623
635
640
644
641
643
636

71a
73a
645
646

700
702
701
703
704

646
622
634
620
631
623
635
624
641
640
644
643

490
450
454
494
462
464
495
8A
8A
465
463
461
461
501
491
493
451
470
453d
453c
453a
492
480a
480
453
455
452
481
481a
50
143
481b
72
453b
471
484
484a
153
482
460b
141
141
460a
120
483
460

GO-DEVIL STORAGE AND DISCHARGE ASSEMBLY

This is a divisional application of application Ser. No. 516,205 filed Oct. 21, 1974, now U.S. Pat. No. 3,955,624.

This invention relates to well tools and more particularly relates to a well safety valve system.

Safety considerations especially in the case of offshore oil wells have become especially critical. When such wells catch fire it is particularly difficult to bring them under control. Offshore wells which rupture, whether or not fire is involved, are major pollution problems causing destruction to marine life, loss of valuable petroleum products, damage to beaches, and are very expensive in the loss of equipment and time. Generally, wells in offshore locations have been protected in two ways against fire or other catastrophic situations. Storm chokes, which are downhole valves, have been used to shut wells in when the flow rate becomes excessive due to various factors which allow uncontrolled flow, such as destruction or damage to the wellhead, rupture of the casing, and the like. Such catastrophes release wells to flow uncontrolled so that the increased flow rate causes the storm choke to close. It will be apparent, however, that well apparatus may become ruptured causing uncontrolled flow which may spill into surrounding water at a rate below that required to close the storm choke, in which case the storm choke is ineffective.

Other forms of saftey systems include various apparatus which may operate responsive to heat, to variations in pressure or flow rate in lines at the platform, and to other changes in operating conditions resulting from or producing platform damage causing fire and/or leakage. Such platform safety systems normally close the wing and master valves in the wellhead tree to shut the well in at the surface. When such platform safety systems are used, burn plugs which respond to excessive heat normally will actuate the safety system and shut in the wells associated with the platform. A fire may, however, cause the flanges and seals on the tree to expand allowing leakage which can be great enough to supply fuel for a fire but is not at a sufficient rate to effect the closing of the storm choke. Under such conditions, the leakage may sustain a fire for an extensive period of time. The problems inherent in the storm choke and platform types of safety systems previously employed indicate the need for a still further safety system of the type disclosed and claimed herein wherein an operating condition change at the platform positively closes a well valve located in the well at a depth which is unaffected by platform equipment damage.

It is a principal object of the invention to provide new and improved well safety apparatus.

It is another object of the invention to provide a new and improved safety valve.

It is still another object of the invention to provide a new and improved downhole well safety valve which is actuated by a go-devil dropped from the surface end of the well responsive to a change in operating conditions of the well system.

It is still another object of the invention to provide a well safety valve system which includes a go-devil type valve adapted to be secured in a well at a desired depth, a go-devil ball for actuating the valve, locking mandrel means for removable supporting the valve in a well, tools for installing and removing the valve, and apparatus for storing and dropping the go-devil ball at the surface end of the well.

It is another object of the invention to provide a go-devil storage and handling assembly which includes rotating rather than sliding reciprocating action to discharge the go-devil into the well bore for preserving the pressure tight integrity of a wellhead in which the assembly is installed.

It is a still further object of the invention to provide a go-devil type well safety valve which mounts above a locking assembly and which includes a trigger type latch activated from above the valve by a go-devil dropped downwardly to the valve.

It is still another object of the invention to provide a go-devil type well safety valve which may be reopened without removing the valve from the well bore.

It is still a further object of the invention to provide a handling tool for use with the go-devil type valve for reopening and/or removing the valve from the well bore.

In accordance with the invention there is provided a well safety system including a go-devil type well safety valve adapted to be removable connected in a well bore to a locking assembly located below the valve and having a trigger type latch which releasable holds the valve in an open position and is activated from above by the impact of a member dropped from the surface through the well bore to the valve. The latch system of the valve includes latching fingers which are propped outwardly to expanded latching positions and are released for inward movement by a tubular shaped operating head driven downwardly by the impact of the go-devil. The assembly forming the impact member handling apparatus includes a pressure tight head assembly secured in the wellhead tree comprising a crank-operated screw type plunger which ejects the member from a pocket positioned at the side of the well bore in the wellhead. The handling apparatus is held in a cocked position by a heat-responsive member which melts at a predetermined temperature to release the crank assembly for rotating the plunger to deposit the ball into the well bore. The go-devil valve reset and pulling tool includes a probe assembly adapted to be inserted into the go-devil valve and operated to reset the go-devil valve when removal is not desired and to engage, open, and retrieve the valve from the well bore. The reset and pulling tool includes meshing operating fingers and dogs which are used to engage the go-devil valve for resetting and retrieving purposes.

The invention together with its objects and advantages will be better understood from a detailed reading of the specification taken in conjunction with the accompanying drawings wherein:

FIG. 1 is a fragmentary broken view in elevation and section schematically illustrating a well equipped with a safety valve system in accordance with the invention;

FIG. 2A and 2B taken together constitute a longitudinal view in section of a go-devil valve embodying the features of the invention and one form of locking assembly constructed in accordance with the invention, showing the valve open;

Figures 1, 2A, 2B:
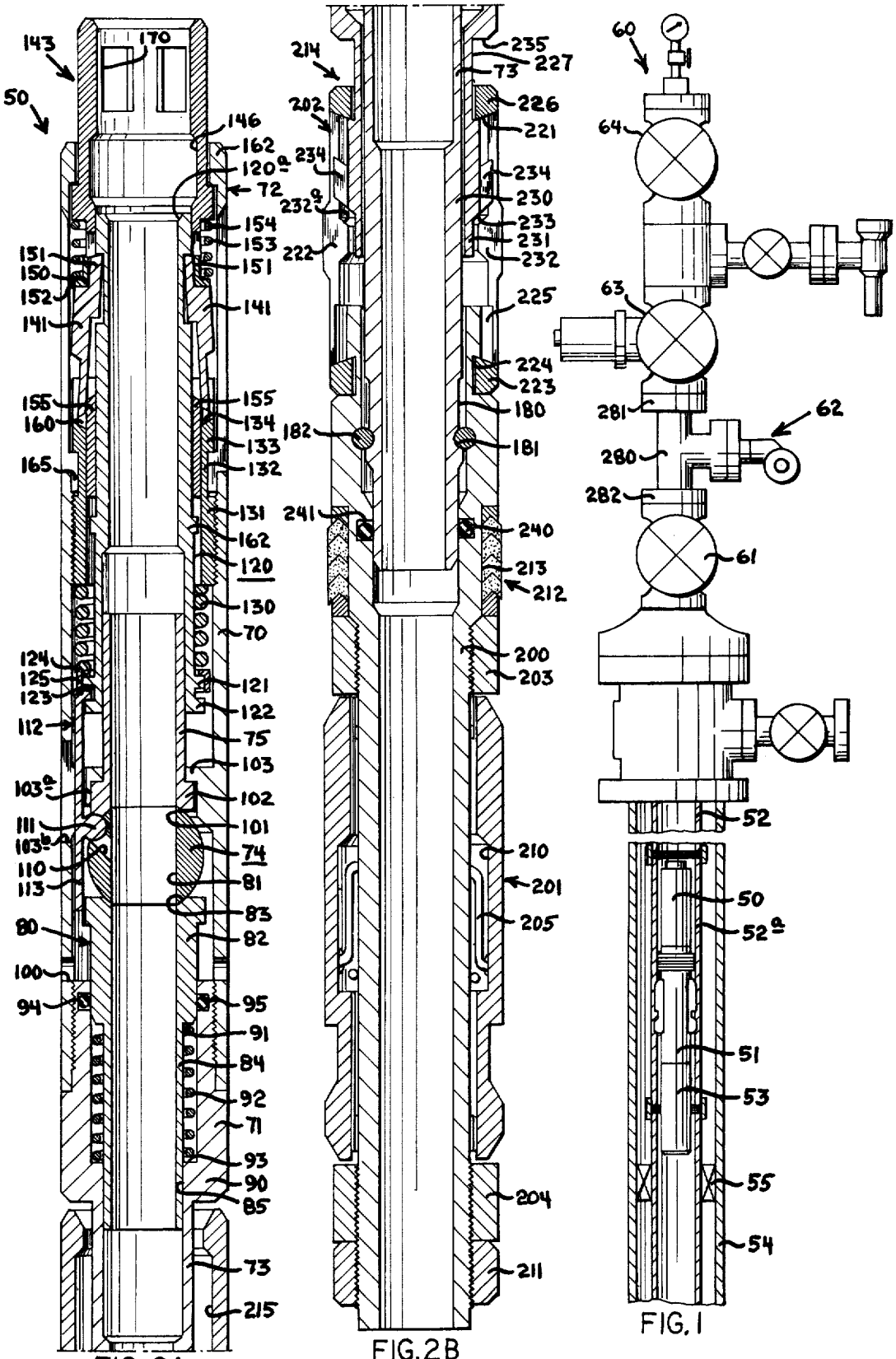
FIG. 2C is a view in section along the line 2C—2C of FIG. 3, showing the position of the ball valve pivot members.
Figures 2C, 4, 5C:
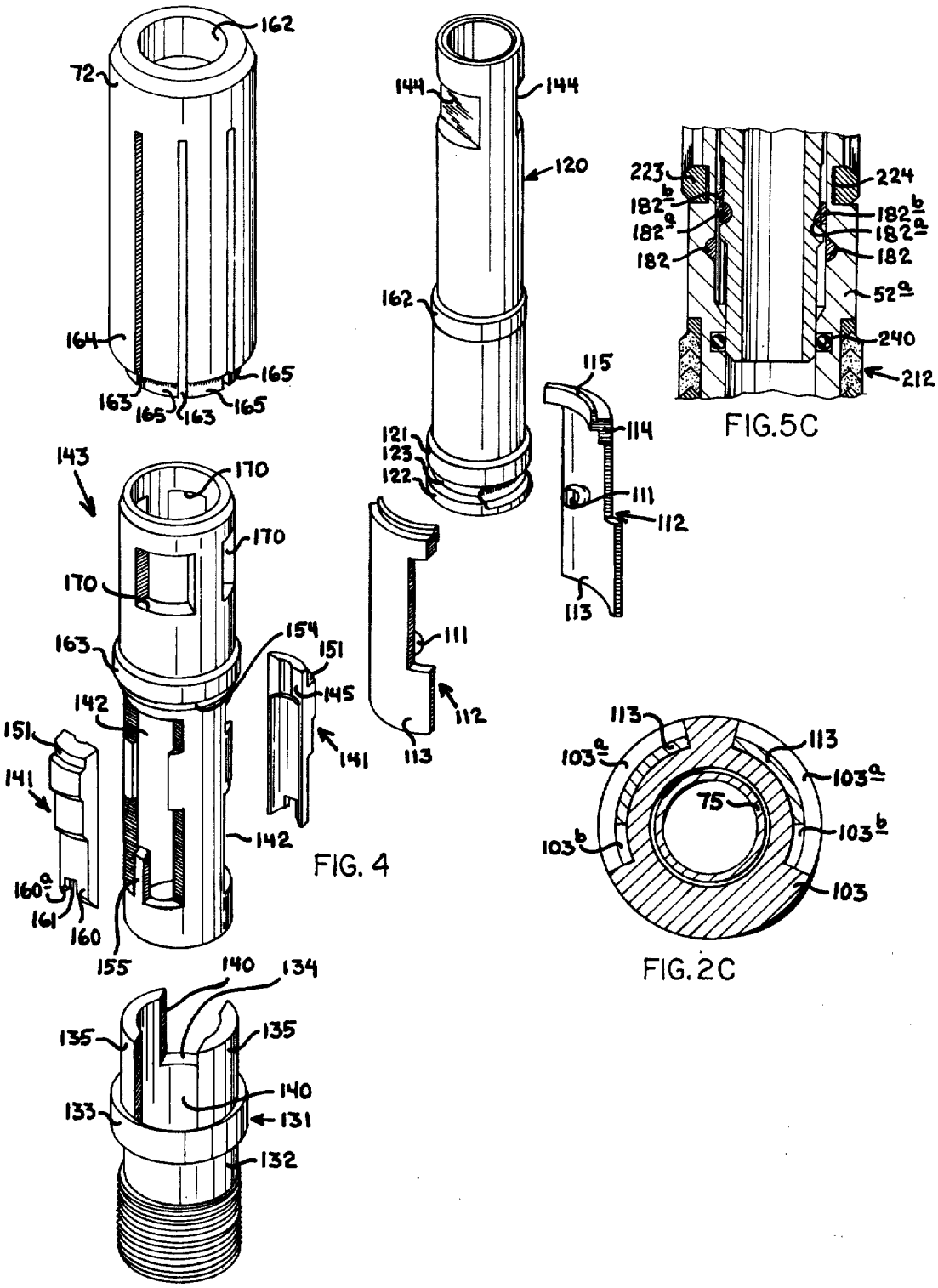
FIG. 4 is an exploded view in perspective of the essential operating parts of the trigger type latch mechanism of the go-devil valve.
Figure 5B:
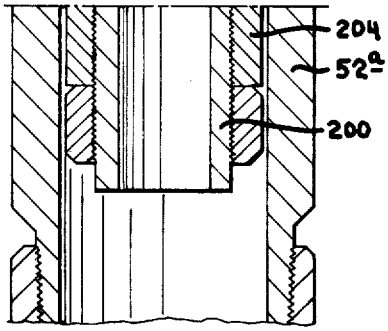
Figure 6:
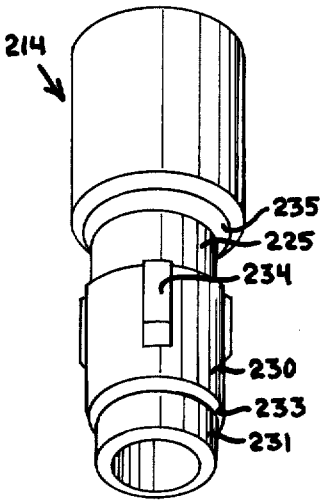
Figure 6:
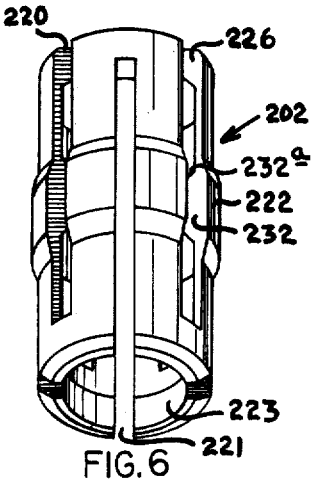
Figure 12B:
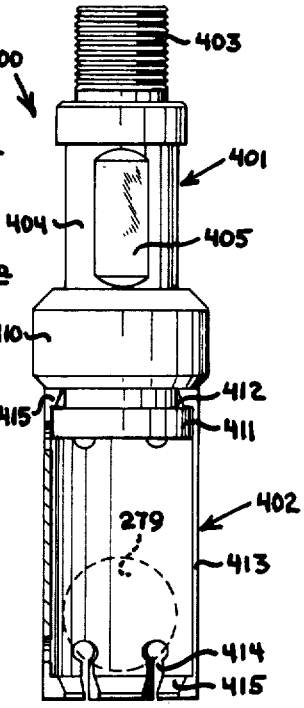
Figure 9C:
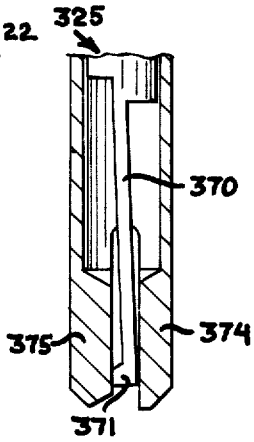
Figure 7:
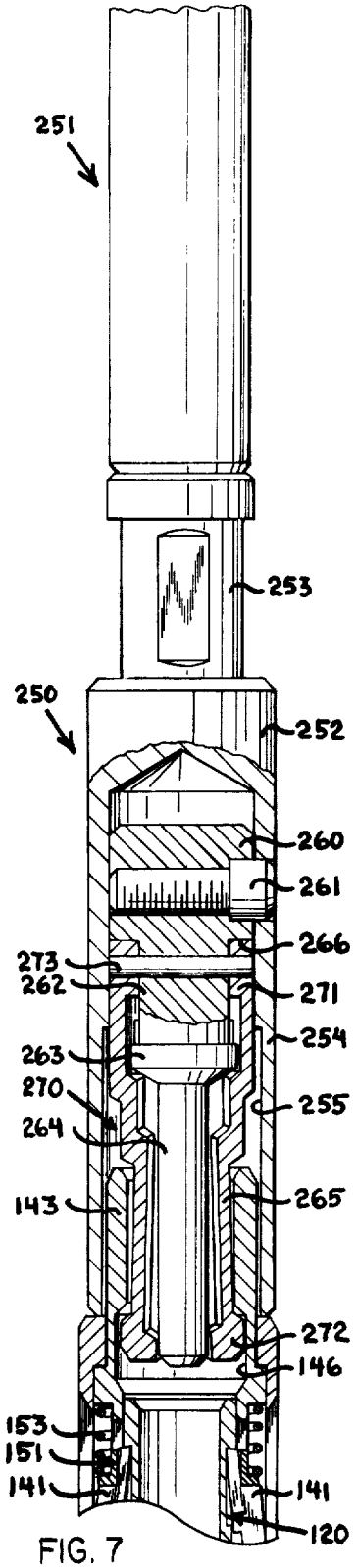
Figure 5A:
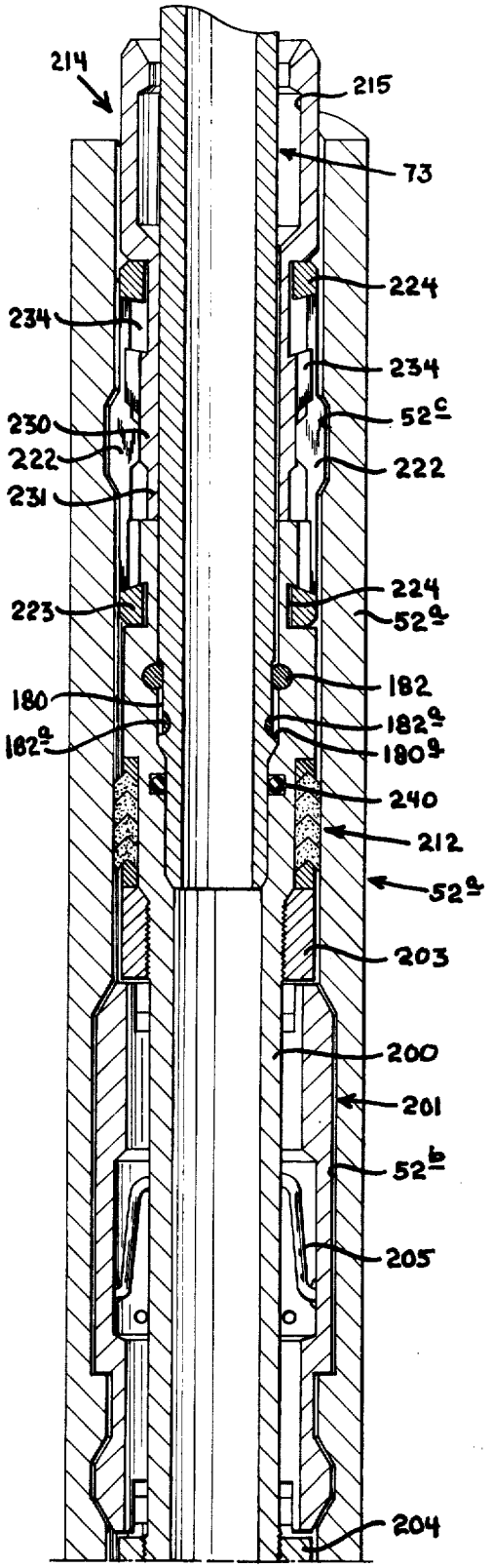
Figures 8, 9A, 9B, 12A, 13, 14, 15:
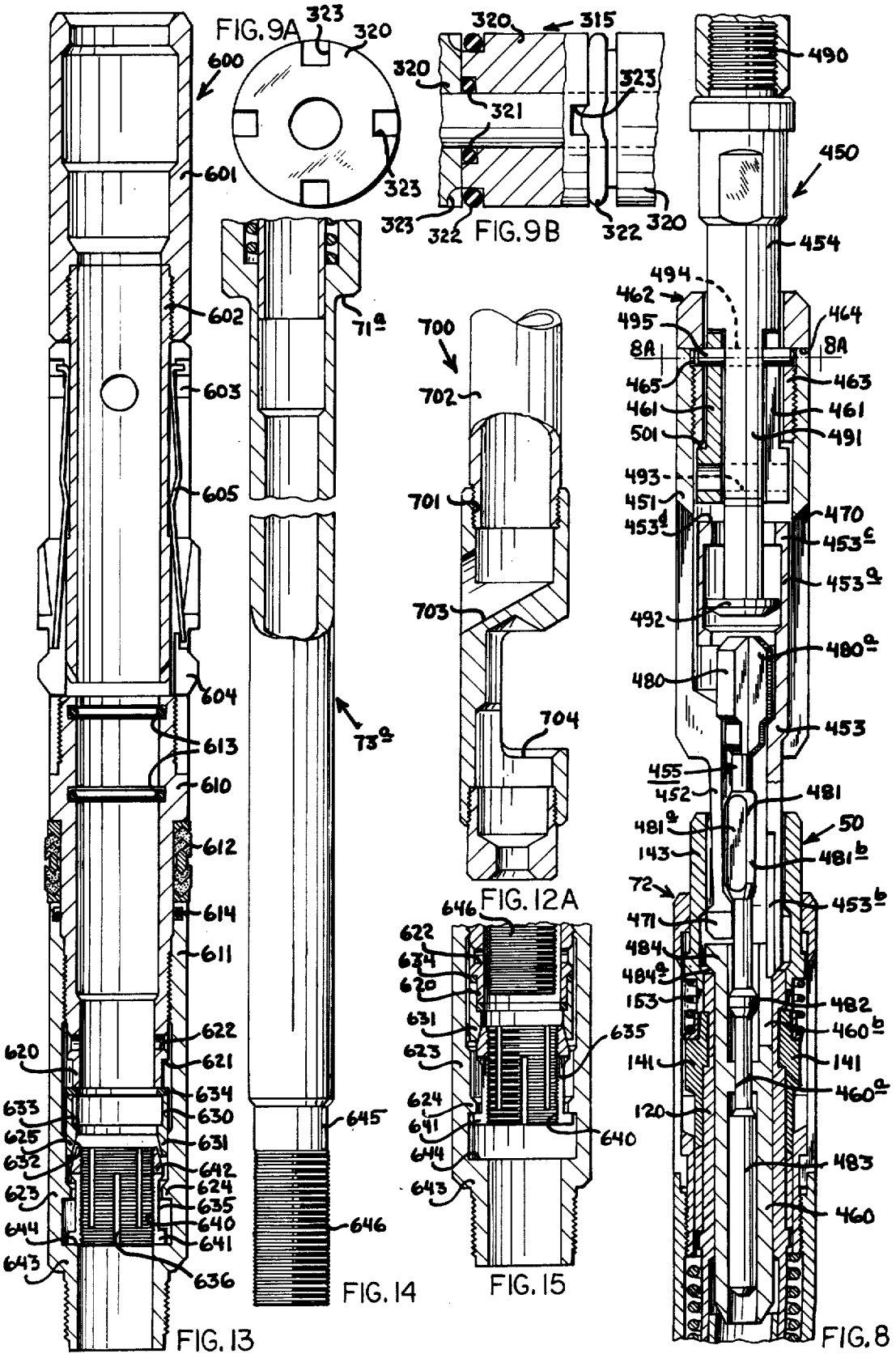
Figure 8B:
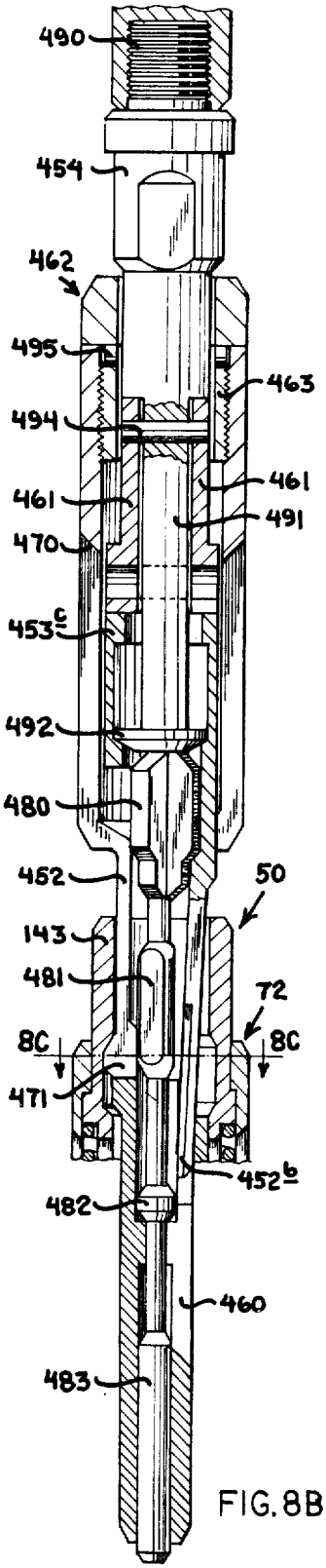
Figure 8D:
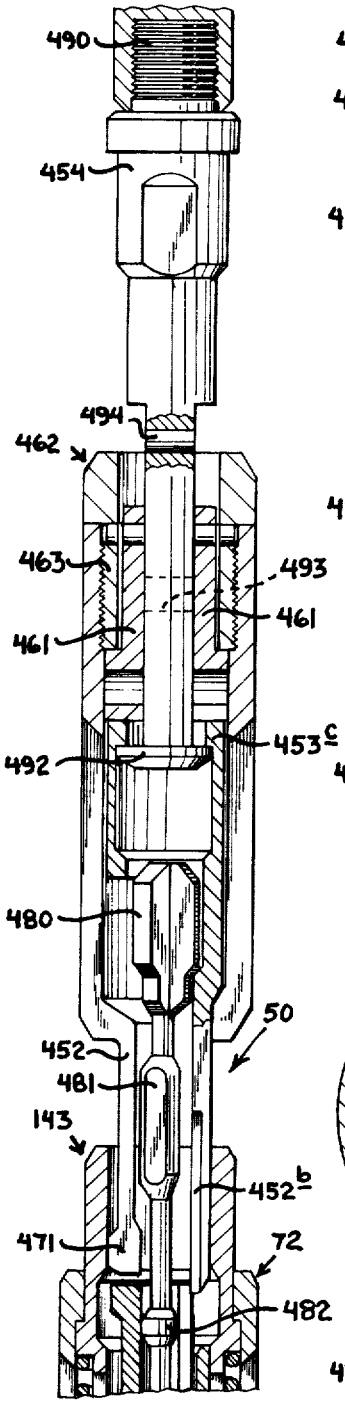
Figure 8E:
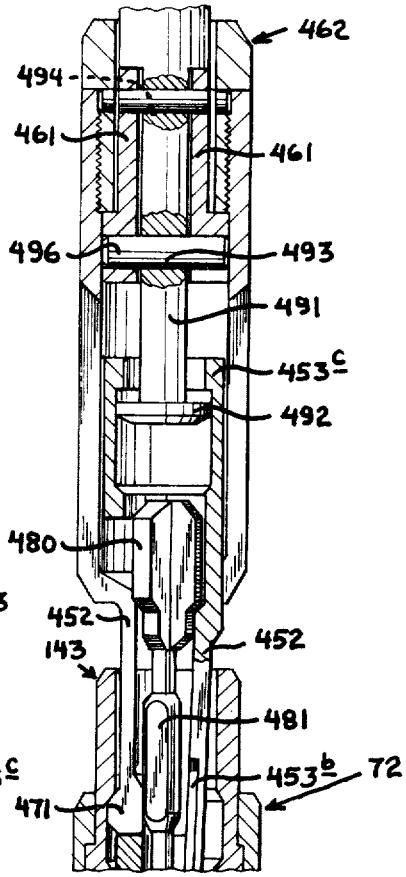
Figure 8A:
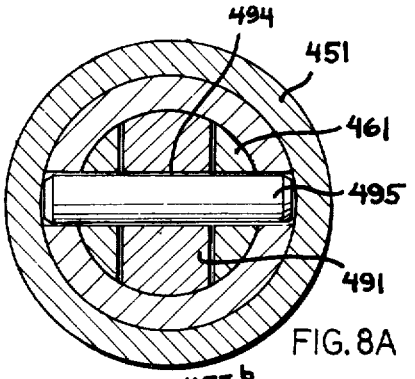
Figure 8C:
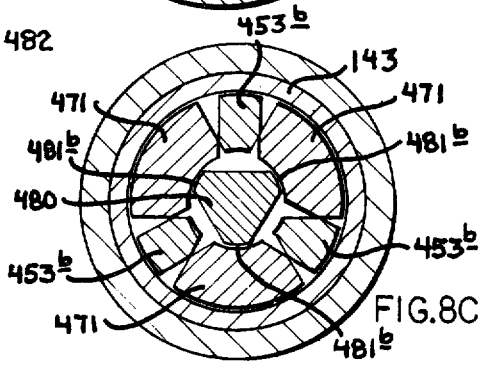
Figure 8F:
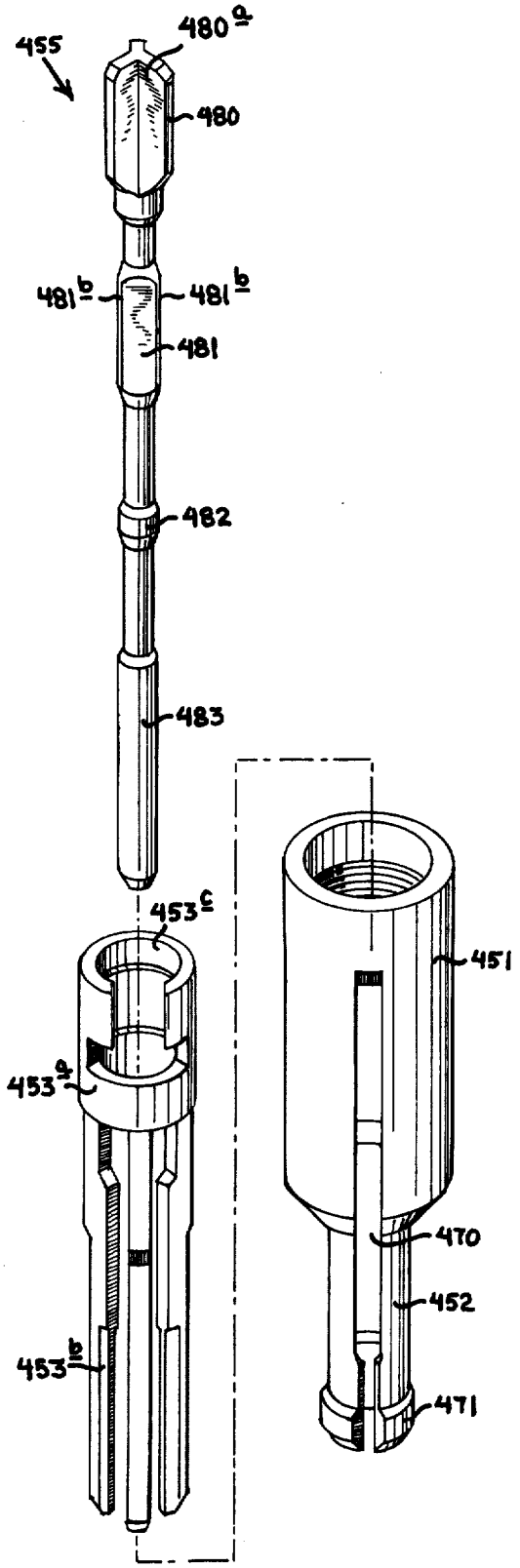
Figure 9:
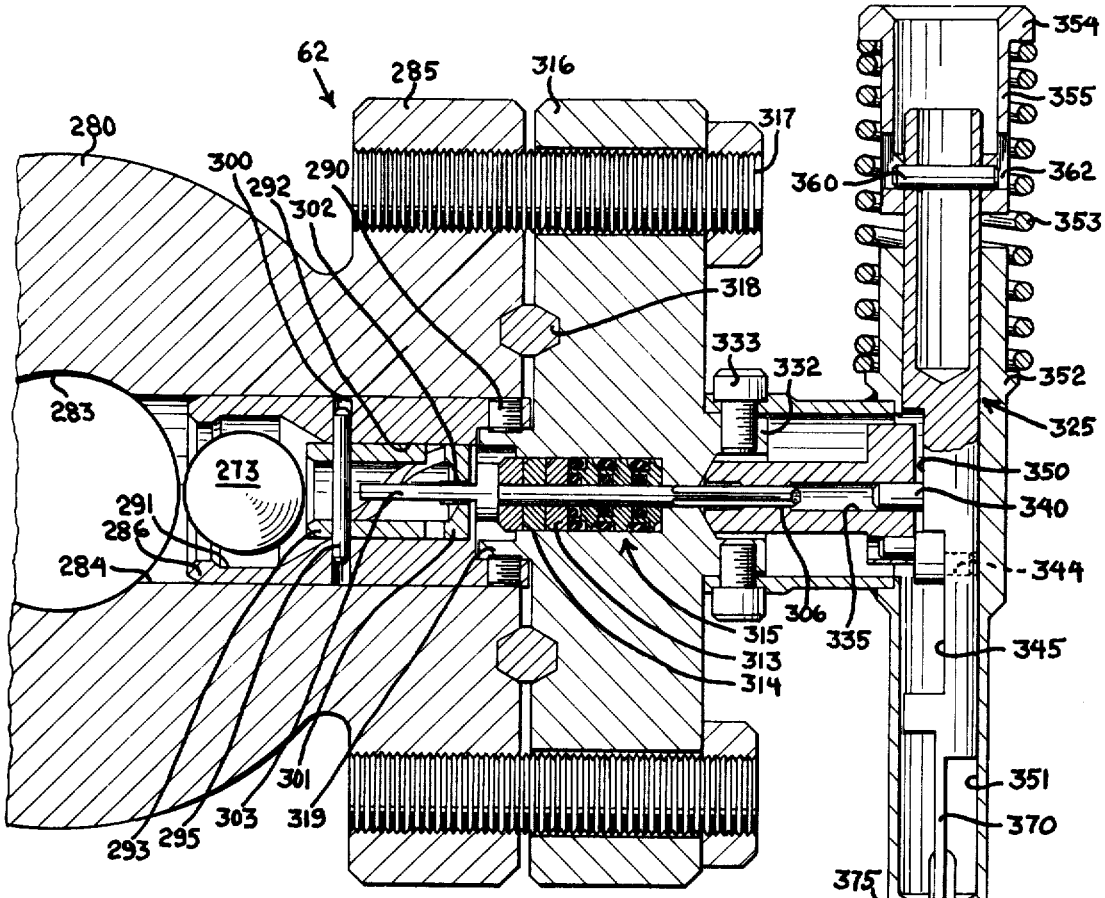
Figure 11:
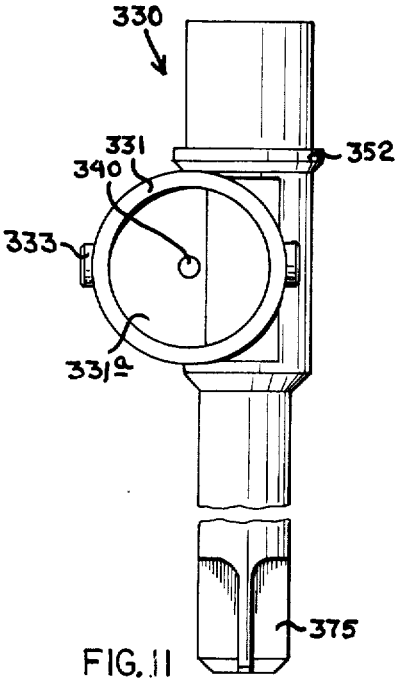
Figure 10:
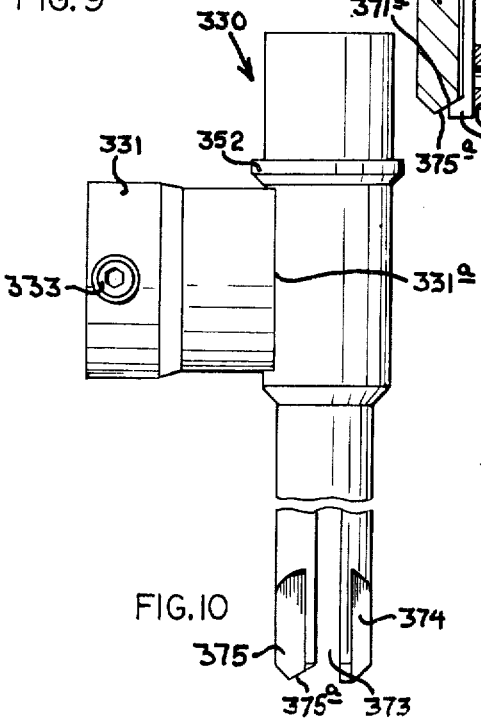
Figure 12:
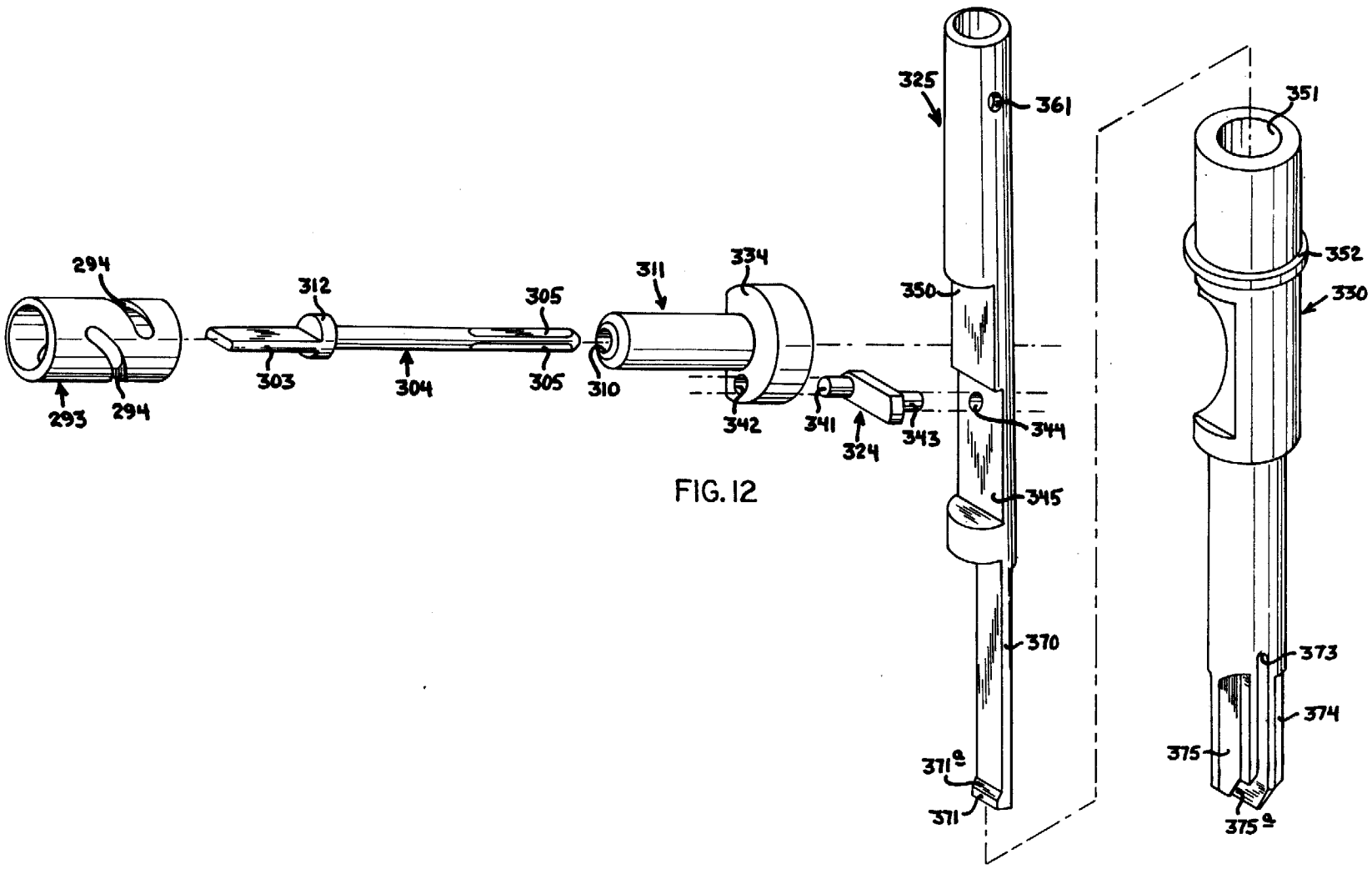

FIGS. 5A and 5B taken together constitute a fragmentary longitudinal view in section of the lower end portion of the go-devil valve and the locking assembly illustrated in FIGS. 2A and 2B showing the locking assembly latched in a landing nipple along the flow conductor of the well bore;

FIG. 5C is a fragmentary view in section of the go-devil valve stinger moved to a release position for disengaging the valve from the locking assembly;

FIG. 6 is an exploded view in perspective of the locking collet assembly of the locking assembly shown in FIGS. 5A and 5B;

FIG. 7 is a fragmentary longitudinal view in elevation and section showing a running tool coupled with the upper end of the go-devil valve for installing the valve in a well bore;

FIG. 8 is a longitudinal view in section and elevation of a reset and pulling tool used for reopening the go-devil valve and for retrieving the valve from a well bore;

FIG. 8A is a view in section taken along the line 8A—8A of FIG. 8 showing the shear pin and shear block arrangement at the upper end of the reset and pulling tool of FIG. 8;

FIG. 8B is a fragmentary view in section showing the reset and pulling tool locked with the go-devil safety valve by driving the control fingers downwardly to expand the locking dogs and dropping the prong of the tool behind the locking dogs;

FIG. 8C is a view in section along the line 8C—8C of FIG. 8B showing the relationships between the control fingers, the locking dog heads, and the locking section of the prong of the reset and pulling tool;

FIG. 8D is a fragmentary view in section showing a further stage in the operation of the reset and pulling tool at which the parts are moved to a position for release of the tool from the go-devil safety valve;

FIG. 8E is a fragmentary view in section illustrating the reset and pulling tool as equipped for retrieving the go-devil valve from a well bore, showing the reset and pulling tool at the stage in the operation at which the tool and go-devil valve are ready for release from the locking assembly;

FIG. 8F is an exploded perspective view of the control fingers, locking dogs, and control prong of the reset and pulling tool;

FIG. 9 is a fragmentary horizontal view in section of the ball dropper used for introducing the go-devil into a well bore;

FIG. 9A is an end view of one washer used in the one-way seal assembly of the ball dropper, showing the O-ring expansion groove in the washer;

FIG. 9B is a fragmentary sectional view of the one-way seal assembly of the ball dropper with the pusher shaft removed to illustrate the O-ring extrusion feature of the one-way seal function;

FIG. 9C is a fragmentary view in elevation illustrating the deflection of the latch finger of the ball dropper after removal of the ball dropper locking washer responsive to a condition such as excessive heat;

FIG. 10 is a broken top view in elevation of the outer housing of the crank assembly of the ball dropper;

FIG. 11 is an end view in elevation of the ball dropper housing shown in FIG. 10;

FIG. 12 is an exploded view in perspective of the essential operating parts of the crank assembly of the ball dropper;

FIG. 12A is a view in section and elevation of a go-devil ball insert and recovery tool;

FIG. 12B is a longitudinal view in section and elevation of a go-devil ball retriever used for removing the go-devil ball from the go-devil valve in a well bore;

FIG. 13 is a longitudinal view in section of an alternate form of locking assembly used to releasably secure the go-devil valve in a well bore;

FIG. 14 is a fragmentary longitudinal view in section and elevation of a modified lower end portion of the go-devil valve stinger adapted for use with the locking assembly of FIG. 13; and FIG. 15 is a fragmentary longitudinal view in section of the lower end of the locking assembly of FIG. 13 illustrating an intermediate step in the release of the go-devil valve from the locking assembly.

Referring to FIG. 1 of the drawings, a well safety system in accordance with the invention includes a go-devil type safety valve 50 secured with a locking assembly 51 latched in a landing nipple 52*a* of a well tubing string 52 above a storm choke safety valve 53. The tubing string 52 is supported within a well casing 54 in which a well packer 55 is installed sealing between the casing and the tubing string. A wellhead connected at the surface on the casing and tubing string comprises a christmas tree 60 which includes a lower master valve 61, a go-devil ball dropper 62, an Otis Type U surface safety valve 63, a tubing access valve 64, and related standard wellhead equipment. The storm choke 53 is a suitable standard downhole type safety valve which responds to a predetermined flow rate in the tubing string 52 to shut in the well. The surface safety valve 63 is connected with a suitable control fluid pressure system, not shown, which is responsive to a control fluid pressure supplied by a system which monitors any desired condition for shutting in the well responsive to a desired change in such condition. In accordance with the invention the ball dropper 62 inserts a go-devil ball into the tubing string which drops to the go-devil valve 50 causing the valve to close. The ball dropper in the particular form illustrated herein functions responsive to a predetermined temperature.

Referring to FIG. 2A, the go-devil safety valve 50 has a central tubular body 70 which is threaded at a lower end on a lower body member 71 and is connected at an upper end to a slotted top 72. Formed integral with and extending downwardly from the lower body member 71 is a tubular stinger 73 which couples the go-devil valve with the lock assembly 51. A ball valve member 74 is rotatably supported in the body 70 between an upper valve seat 75 and a lower valve seat 80 for controlling flow through the go-devil valve. The ball valve 74 has a bore 81 through which fluids may flow when the go-devil valve is open as shown in FIG. 2A.

The lower valve seat 80 has a head 82 provided with an upper end internal annular sperical valve seat 83 for engagement with the valve 74. A reduced lower portion 84 of the lower valve seat telescopes into a reduced bore 85 in a reduced lower end portion 90 of the bottom body member 71. The lower end of the head 82 of the lower valve seat 80 has a downwardly facing external annular shoulder 91 engaged by the upper end of a spring 92 which seats at a lower end on an upwardly facing, internal annular shoulder 93 within the lower body member 71. The spring 92 biases the lower valve seat 80 upwardly against the ball valve 74. An internal annular ring seal 94 within an internal annular recess 95 at the upper end of the body member 71 seals between the body member 71 and the head 82 of the lower valve seat 80. A plurality of circumferentially spaced ports 100 are provided in the central body 70 opening into the body above the upper end of the lower body member 71 to prevent the entrapment of fluid within the body around the valve operating structure to allow the valve 74 to freely open and close. In addition to biasing the lower valve seat 80 upwardly, the spring 92 and the telescoping action of the lower valve seat 80 permits the valve 74 to be pumped downwardly to open the valve as discussed in more detail hereinafter.

The upper valve seats 75 of the go-devil safety valve 50 has a downwardly facing internal annular sperical seat surface 101 which engages and seals with the ball valve 74. The seat 75 has a lower external annular flange 102 which engages an internal flange 103 provided within the central body 70 limiting the upward movement of the upper valve seat 75 to the position shown in FIG. 2A. With the upper valve seat thus limited against upward movement, the ball valve 74 is held between the upper and lower valve seats by the biasing effect of the spring 92 urging the lower valves seat upwardly against the ball valve. The upper valve seat 75 fits sufficiently loosely through the internal body flange 103 that the upper valve seat may drop downwardly from the position shown in FIG. 2A, particularly under such circumstances as when the ball valve is pumped downwardly to open the valve. It will be evident, however, that there is no downwardly biasing force against the upper valve seat 75 under normal operating conditions, though it will be recognized that if the valve is pumped downwardly there will be some fluid pressure differential across the valve seat which would tend to urge it downwardly following the ball valve 74 as the ball valve is pumped open.

The ball valve 74 of the go-devil safety valve 50 has a pair of operating holes 110 which are positioned approximately 110° apart measured in terms of the axis of the ball valve taken through the ball valve bore 81. Each of the operating holes 110 receives an operating lug 111 formed on the inner face of a pivot member 112. As seen in FIG. 4, two pivot members 112 are used with the ball valve for rotating the ball valve to open and close the valve. Each of the pivot members is a cylindrical segment having a downwardly extending skirt portion 113 which fits within the body 70 through arcuate slots **103*a* in the flange 103. The slots 103*a* are spaced about 110° apart for proper positioning of the pivot members. The body has side windows 103*b* to admit the pivot members during assembly of the go-devil valve. The relationship of the pivot members, the flange 103, and the windows 103*a* are shown in FIG. 2C. The pivot members have internal head flange portions 114, each of which is provided with an upwardly extending lip 115. The lower end of the operator tube 120 has a pair of vertically spaced external annular flanges 121 and 122 which define an external annular recess 123 which receives the internal flange portions 114 and the lips 115 at the upper ends of the pivot members 112 so that the pivot members hang from the lower end flange 122 of the operator tube. A retainer ring 124 is supported on the upper flange 121 and includes a downwardly extending skirt 125 which overlaps the lip 155 on the upper end of each pivot member 112 locking the upper ends of the pivot members with the operator tube. A spring 130 around the operator tube bears against the retainer ring 124 holding the ring in place and biasing the operator tube 120 downwardly. The upper end of the spring 130 engages the lower end edge of an internal tubular member 131 which is threaded along a lower end portion into the upper end of the body member 70. The member 131 has an external annular recess 132 above the lower threaded portion, an external annular flange 133 above the recess, a downwardly and inwardly sloping annular locking surface 134 on the upper end of the flange 133, and a pair of upwardly extending diametrically opposed cylindrical segments 135. The segments 135 are circumferentially spaced to define a pair of diametrically opposed upwardly opening windows 140**.

Figure 3:
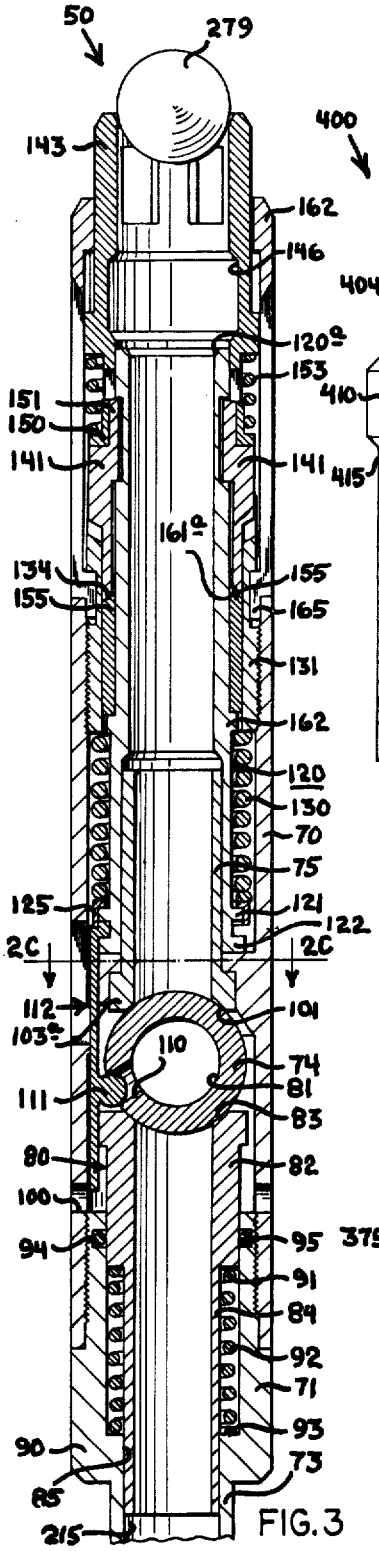
FIG. 3 is a fragmentary longitudinal view in section illustrating the go-devil valve closed.

A pair of latching dogs 141 are disposed on the operator tube 120 within the valve top 72 for movement between expanded locking positions shown in FIG. 2A and retracted release positions as illustrated in FIG. 3. The dogs 141 are supported within lateral windows 142 provided along opposite sides of a head 143 which telescopes into the valve top 72 over the operator tube 120. The operator tube 120 has a pair of diametrically opposed outwardly opening recesses 144 near the upper end thereof, each of which receives an inwardly projecting internal boss 145 formed along the inner face of the upper end of each of the dogs 141. A retainer ring 150 is positioned around the upper ends of the dogs 141 to clamp the dogs on the operator tube 120. The ring 150 encirles the upper ends of the dogs in upwardly and outwardly opening recesses 151 along each of the locking dogs. The ring 150 has a bottom external annular flange 152 which supports the lower end of a spring 153 bearing at an upper end against a downwardly facing shoulder 154 on the head 143 to releasably hold the head at an upper dog locking end position as shown in FIG. 2A. The head 143 has an upwardly projecting dog latch finger 155 which extends upwardly along the center line of each of the lateral windows 142. Each of the dogs 141 has downwardly extending legs 160 which are spaced to define a downwardly opening central recess 161 which is slightly wider than the latch fingers 155 so that the latch finger 155 fits within the recess 161 of the locking dog when the dog is in the retracted release position of FIG. 3. The upper end of the recess 161 is defined by a downwardly and outwardly sloping edge surface **161*a* which coacts with the upper end of a latch finger 155 to cam a dog 141 outwardly to latch the valve open. In the relative positions of the locking dogs and the head 143 shown in FIG. 2A at which the valve is open and the locking dogs are latched outwardly, the dogs are propped outwardly in the expanded locking positions by the latch fingers 155, each of which fits behind a dog 141 when the head 143 is at the upper locking position on the tube 120. An external annular flange 162 on the operator tube 120 limits the downward movement of the head 143 on the operator tube to a lower end position at which the locking dogs 141 are released to move inwardly. As seen in FIG. 4, the lower end edge 160*a* of the leg portions 160 on the locking dogs 141 taper downwardly and inwardly providing locking and cam surfaces engageable with the downwardly and inwardly tapered locking and cam surface 134 on the internal member 131. When the dogs 141 are propped outwardly, the dog end edges 160*a* engage the annular locking shoulder 134 holding the dogs and tube 120 up to latch the go-devil safety valve open. When the locking dogs 141 are not propped outwardly by the latch finger 155, the camming action between the end edge surfaces 160***a* of the dogs and the surface 134 pivots the locking dogs 141 inwardly to the release positions disengaged from the surface 134 as in FIG. 3.

The top 72 has an internal annular flange 162 which is engageable with an external annular flange 163 on the head 143 to hold the head 143 within the go-devil valve body as illustrated in FIG. 2A. The top 72 has a plurality of circumferentially spaced downwardly opening slots 164 defining circumferentially spaced, dependent collet fingers 164*a* which have downwardly extending internal end flanges 165 received within the external annular recess 132 of the member 131. The flanges 165 extend into the upper end of the body 70 projecting above the threaded portion of the member 131. By providing the collet fingers 164 assembly of the head member 72 with the member 131 is facilitated with the member 72 being held coupled with the member 131 by the internal flange portions 165 of the collet fingers 164*a*. The upper end of the member 143 is provided with circumferentially spaced windows 70 to aid seating of the go-devil ball on the valve head.

The lower end of the stinger 73 of the go-devil valve 50 telescopes into the locking assembly 51 for locking the valve with the assembly. The stinger is reduced in diameter at 180 defining a stinger section across which lateral shear pin recesses 181 are provided for lateral shear pins 182 which lock the go-devil stinger in the locking assembly. The shear pin recesses 181 are provided at the lower end of the reduced stinger portion 180 so that the diameter of the stinger above the shear pins 182 is less than the diameter of the stinger below the shear pins to provide the shear pins with a dual locking function operable when initially running to go-devil valve and lock assembly into a well and also when releasing the go-devil valve from the lock assembly to pull the valve from a well. As discussed hereinafter, in driving the stinger 73 downwardly to lock the assembly 51, inner segments of the shear pins are sheared defined by the diameter of the stinger section 180 above the shear pins. Similarly, in withdrawing the stinger from the lock assembly 51 larger central segments of the shear pins are sheared as defined by the diameter of the stinger below the shear pin recesses 181.

The locking assembly 51 includes a body mandrel 200 which supports lower locating keys 201 and an upper locking collet 202. The lower locating keys are standard elements used in a number of different types of locking assemblies for locating the assembly at a desired landing nipple which has an internal key recess profile corresponding with the external profiles on the locating keys. As the locking assembly is lowered along a flow conductor provided with one or more landing nipples, the keys 201 will spring outwardly only into the nipple profile which is compatible with the keys. The keys 201 are held on the mandrel 200 by upper and lower key adapters or retainers 203 and 204, respectively, for holding the upper and lower ends of the keys while permitting them to expand and contract radially. The keys are each biased outwardly by a spring 205 positioned around the body mandrel within a recess 210 within each key. A locating and locking mandrel assembly together with a compatible landing nipple utilizing keys of the type illustrated in FIGS. 2B and 5A are shown at page 3962 of the 1974–75 edition of the *Composite Catalog of Oilfield Equipment and Services* published by World Oil, Houston, Texas. The lower key retainer 204 is secured on the mandrel by a nut 211 threaded on the mandrel below the key adapter. An external seal assembly 212 is secured within a recess 213 of the body mandrel 200 by the upper end of the upper key adapter 203. The seal assembly 212 seals around the locking assembly body mandrel within a landing nipple along the flow conductor in which the locking assembly and go-devil safety valve are installed, such as the nipple 52*a* illustrated in FIG. 5A.

The upper locking collet 202 of the locking assembly 51 is coupled with the upper end of the body mandrel 200 and with a fishing neck 214 which telescopes into the locking collet and is provided with an internal recess 215 for the engagement of a suitable handling tool, not shown. The configurations of the upper locking collet 202 and the fishing neck 214 are best illustrated in FIG. 6. The locking collet 202 has a plurality of circumferentially spaced upwardly and downwardly opening longitudinal recesses 220 and 221, respectively. The longitudinal slots extend only partially the length of the locking collet so that alternate upwardly and downwardly extending collet fingers are defined, each of which is provided with an external locking boss 222 for releasably securing the locking assembly 51 at a landing nipple along a tubing string. Downwardly extending portions of the locking collet fingers include internal flange portions 223 which are received within an external annular recess 224 around the upper end portion of the body mandrel 200 for holding the lower end of the locking collet 202 to the body mandrel. The body 200 has circumferentially spaced lugs 225 above the recess 224 coupling the collet 202 with the body. Similarly, the upwardly extending collet fingers defined by the slots each has an internal upper flange portion 226 received within an external annular recess 227 around the fishing neck 214. The fishing neck 214 has an enlarged locking portion or surface 230 below the recess 227 and a reduced lower end release portion 231. The locking fingers of the collet 202 each has an internal locking boss 232 engageable by the locking section 230 of the fishing head when the fishing head is driven downwardly to latch the locking assembly in a landing nipple. The release surface 231 along the lower end portion of the fishing head 214 is joined with the collet holding surface 230 by a downwardly and inwardly sloping cam surface 233 which expands the collet fingers as the fishing head 214 is driven downwardly durning the setting of the locking assembly. Circumferentially spaced radial lugs 234 are formed on the surface 230 of the fishing neck aligned to engage the downwardly opening slots 221 for coupling the fishing neck and the collet. The fishing neck and collet are assembled by inserting the fishing neck into the collet with the lugs 234 aligned with the slots 220 and then turning the fishing neck relative to the collet until the lugs are aligned with and enter the slots 221. As can be seen in FIG. 2B, the effective diameter defined by the outer surface of the lugs 234 is sufficiently large that with the lugs inserted in the slots 221 the fishing neck will not easily disengage from the collet in response to upward force. The collet 202 is coupled on the body 200 by inserting the body lugs 225 into the slots 221 and rotating the body or collet to rotate the lugs into the slots 220 of the collet. A downwardly facing external annular shoulder 235 on the fishing neck 214 defines the upper end of the recess 225 on the fishing neck.

An internal annular seal 240 carried within an internal annular recess 241 within the locking assembly body 200 seals around the stinger 273 when the go-devil valve is coupled with the locking assembly, as shown in FIG. 2B. The locking assembly 51 is run and set on the go-devil safety valve, though when removal is required, the safety valve is first retrieved and the locking assembly is then pulled by means of a standard suitable tool, not shown, which engages and lifts the fishing neck 214.

The go-devil safety valve 50 together with the locking assembly 51 are run and set in a well bore by means of a running tool 250, FIG. 7, supported from a tubular handling string 251. The running tool has a tubular body 252 having a reduced upper end portion 253 which threads into the lower end of the lower section of the handling string. The body 252 has a downwardly extending skirt 254 defining a downwardly opening bore 255. A core 260 is secured in the body by a socket head screw 261. The core has a intermediate reduced portion 262 provided with a lower end external annular flange 263. A downwardly extending locking probe 264 is formed on the core to control the radial expansion and contraction of a plurality of collet fingers 265 on a locking collet 270 supported within the body skirt 254 from the core. The head end of the collet 270 has an internal annular flange 271 which fits around the core reduced portion 262 to support the collet on the core on the flange 263. The collet fingers 265 each is provided with a collet head 272 for releasably locking within an internal annular recess 146 within the head 143 of the go-devil valve. The collet 270 is movable on the core of the running tool between an upper locking position on the core as shown in FIG. 7 and a lower release position on the core, not shown. The collet 270 is held at the upper locking position by a shear pin 273 which extends through the collet head and the core portion 262 as illustrated in FIG. 7. At this upper position of the collet 270 on the core 260 the lower end of the probe 264 is aligned within the collet heads 272 holding the collet heads in expanded locking positions. When the pin 273 is sheared, the collet 270 may drop downwardly on the core or alternatively the core 260 may be lifted within the collet so that the probe 264 is raised above the collet finger heads 272 so that the collet fingers may contract inwardly to release positions. When running the go-devil valve with the tool 250, the shear pin 273 is in position as shown in FIG. 7 to hold the collet upwardly on the probe so that the probe is within the collet finger heads to maintain the heads expanded to lock the tool with the head of the go-devil valve. The running tool is coupled with the go-devil by assembling the tool on the valve head 143. With the core 260 inserted into the collet 270 and before the shear pin 273 is installed the collet is allowed to drop downwardly on the core until the flange 271 of the collet rests on the core flange 263. At this position of the core 260 in the collet 270 the lower end of the probe 264 is above the collet heads 272 so that the collet heads are inserted into the head 143 of the go-devil valve until the collet heads 272 are within the locking recess 146 of the head. The core 260 is then forced downwardly into the collet until the upper end of the collet engages the shoulder 266 on the core in which position the lower end of the probe expands and holds the collet heads 272 in the locking positions shown in FIG. 7. The shear pin holes in the collet head and the core are aligned and the shear pin 273 is inserted to lock the core and collet together so that the collet heads will be held expanded. The body 252 is then lowered over the assembled core and collet until the lower end of the skirt 254 engages the top of the go-devil valve head and the socket head screw 261 is inserted through the skirt into the core to lock the body 252 on the assembled core and collet. In this assembled relationship the go-devil valve may be run into the well bore.

The ball dropper 62 illustrated in FIGS. 9–12 is the part of the christmas tree 60 used to insert an impact member in the form of a go-devil ball 279 into the well bore to close the go-devil safety valve. The ball dropper has a tubular body 280 provided with opposite end flanges 281 and 282 and a vertical bore 283 which is aligned with the bore through the christmas tree leading to the tubing string 52. The ball dropper body has a horizontal side bore 284 opening through a side flange 285 and intersecting the vertical bore 283 for housing storage and ejection mechanism for the go-devil ball 279. A tubular ball pocket 286 is secured within the bore 284 by set screws 290. The ball pocket has a mouth portion 291 which holds the go-devil ball 279 and a reduced bore portion 292 which holds a rotatable tubular ball pusher 293. The pusher has a pair of helical slots 294 arranged to receive a lateral pin 295 extending between identical lateral holes 300 aligned on opposite sides of the pocket 286 intersecting the two slots 294 so that rotation of the pusher within the bore 294 relative to the fixed pin 295 drives the pusher inwardly to engage the go-devil ball 273 for pushing the ball inwardly out of the slot to drop it into the bore 283. The pusher 293 has a closed outer end 301 provided with a lateral slot 302 which receives a rectangular shaped drive bar 303 formed on the inward end of a drive rod 304. The drive rod has an end configuration providing flat surfaces 305 which fit along internal drive flange surfaces 306 within a bore 310 of a crank 311. The drive rod 304 has a circular thrust bearing flange 312 which bears against thrust washers 313 through which the drive bar extends in a bore 314 in a flange 316 secured to the ball dropper body. Outwardly of the thrust washers a set of one-way seal assemblies 315 are disposed in the bore 314 around the drive rod 304 to prevent leakage from within the body outwardly along the bar. The seal assemblies are arranged to leak inwardly so that pressure pockets cannot develop between them while they seal against leakage in an outward direction from within the wellhead. Each of the seal assemblies comprises an annular washer-like member 320 having inner and outer annular concentric recesses 321 and 322, respectively. The face of each member 320 opposite the recesses 321 and 322 had outwardly opening circumferentially spaced notches 323 aligned with the outer recess 322 of an adjacent member 320. The notches 323 permit inward extrusion of small segments of the O-ring in the adjacent outer recess 322 so that the O-ring will leak inwardly toward the wellhead, thereby preventing pressure pockets developing between the seal assemblies within the bore 314 of the flange 316. The notches allow the inward leakage only, while the O-rings will seal against leakage in an outward direction along the rod 304 and along the surface of the bore 314. The notches are located at static surfaces along which the desired inward leakage is permitted, while the seals along the rotatable rod 304 are fixed so that the relief of pressure pockets is only along the outer seal recesses 322 and notches 323. The flange 316 is secured with the flange 285 by bolts 317. A ring seal 318 seals between the flanges 285 and 316. The flange 316 has an inwardly extending lip 319 projecting from the inner face of the flange into an enlarged portion of the body bore 292 so that the lip is engaged by the set screws 290.

The ball dropper crank 311 is coupled by a link 324 to a plunger 325 within a plunger body 330. The plunger body is secured with a tubular housing 331 which fits on a tubular flange 332 on the outer face of the flange 316 secured by set screws 333.

The crank 311 has a semi-circular head 334 through which a bore 335 of the crank opens to receive a pin 340 extending coincident with the axis of rotation of the crank for supporting the outward end of the crank with an end face 331*a* of the housing 331. The link 324 has a first pin 341 which fits in a hole 342 in the crankhead 334. The link 324 has a second pin 343 which fits in a hole 344 of the plunger 325 so that longitudinal movement of the plunger causes rotation of the crank to turn the pusher 393 for depositing the go-devil ball in the well bore. The plunger 325 has a first longitudinal flat surface 345 defining the bottom of a recess to provide space for the body of the link 324 between the outer face of the crank head 334 and the plunger. Another plunger surface 350 defines the bottom of a shallower recess along the plunger in which the crank head 334 fits. The coupling between the crank and the plunger forms connection whereby the longitudinal movement of the plunger effects rotation of the crank through the mechanism of the link 324.

The plunger 325 slides within the bore 351 of the body 330. The body 330 has an external annular flange 352 which supports an end of a spring 353 the other end of which bears against a flange 354 on a puller head 355 coupled by a pin 360 with the plunger 325. The pin 360 fits through lateral holes 361 provided in the end portion of the plunger. The pin 360 is connected with the puller head 355 by means of slots 362 provided in the puller head. The spring 353 biases the plunger 325 in a direction to rotate the crank 311 in the proper direction for forcing the pusher 393 inwardly in the ball dropper body.

The end portion of the plunger 325 opposite the spring section comprises a substantially flat, thin latch finger 370 provided with an end catch 371. The body 330 has a longitudinal slot 373 defining a pair of endwardly extending fingers 374 and 375 which function in the locking and release of the plunger 325. The width and the position of the slot 373 is so related to the position of the latch finger 370 that the catch 371 overlaps the body finger 375 as illustrated in FIG. 9 when the latch finger 370 is positioned to lock the ball dropper in a cocked condition. More specifically, the tapered locking surface 371*a* on the catch 371 engages a correspondingly tapered locking surface 375*a* on the end of the body finger 375 preventing the longitudinal inward movement of the plunger 325 so long as the catch arm 370 is held at the cocked position of FIG. 9. It will be obvious that both the catch finger 370 and the body fingers 374 and 375 of the body 330 are somewhat flexible and may be distorted laterally relative to the longitudinal axis of the plunger and body when a force is applied to the plunger tending to move it inwardly into the body. The latch finger 370 is locked at the cocked position shown in FIG. 9 by a washer 380 formed of a material such as lead which will melt at a predetermined temperature. The spacing between the face of the latch finger 370 and the inside face of the finger 374 and the thickness of the washer 380 are so proportioned that the washer is frictionally held in place as shown in FIG. 9 to prevent the lateral fixing of the latch finger 370. The thickness of the catch 371 on the finger 370 and the width of the slot 373 between the fingers 374 and 375 permit the catch 371 to move into the slot between the fingers 374 and 375 to release the plunger 325 for longitudinal movement in the body 330 when the washer 380 is removed from the lock position by melting or destruction in some other manner or by physical removal from between the finger 374 and the finger 370. In the cocked position of the ball dropper as represented in FIG. 9, the plunger 325 is held against the compressed spring 353 by latching the finger 370 with the washer 380 as illustrated. At this location of the piston the spring 353 is compressed sufficiently that there is a biasing force applied by the spring through the head 354 to apply a pulling force on the piston through the pin 360 which tends to pull the finger catch 371 into the body 330 as viewed in FIG. 9. So long, however, as the washer 380 is in place, the piston 325 cannot move from the locked position shown. At this position, the pusher 393 is retracted in the body bore 392 to a location at which the go-devil ball 373 remains within the open end of the pocket member 285. Upon removal of the washer 380 or destruction by heat, the force of the spring 353 moves the plunger 325 upwardly as seen in FIG. 9 whereby the camming action between the catch surface 371*a* and the locking surface 375*a* on the finger 375 flexes the catch finger 370 laterally until the finger is sufficiently distorted that the catch 371 enters the slot 373 releasing the plunger 325 to move upwardly. Such upward movement of the plunger pulls the link 324 rotating the crank 311 turning the rod 304 thereby rotating the pusher 293 in the bore 292. As the pusher 293 rotates relative to the fixed pin 295 which intersects the slots 294 of the pusher, the pusher is driven inwardly engaging the go-devil ball 273 ejecting the ball from the pocket dropping it into the bore 283. By operating the ball dropper with only rotation of the rod 304 required rather than having to slide the rod in and out, less force is needed and the pressure tight integrity of the wellhead is preserved.

The go-devil ball 279 may be recovered from the well bore by use of a ball plucker 400 illustrated in FIG. 12B. The ball plucker comprises a body 401 and a ball engaging sleeve or skirt 402. The body has a reduced upper threaded end portion 403 which is engageable with a handling string which may be wireline tools connected together of sufficient length to reach a ball on the go-devil safety valve in a well bore. The body has a reduced central section 404 provided with flat surfaces 405 for engagement by a suitable wrench or other tool for tightening the threaded section 403 at the end of a handling string. The body has an enlarged lower end portion 410 provided with an external annular flange 411 spaced downwardly from the body portion 410 to define a recess 412 for securing the ball sleeve 402 with the body. The ball sleeve is a tubular member open at opposite ends and having longitudinal slots 413 and inwardly opening recesses 414 to facilitate securing the sleeve to the body and to permit some expansion to allow entry of the go-devil ball into the sleeve. The opposite ends of the sleeve 402 are internally flanged as at 415 so that one end of the sleeve snaps into place on the body 401 as illustrated in FIG. 12 with the flanged portions entering the recess 412 for holding the sleeve coupled with the body. The open lower end of the sleeve thereby permits entry of the go-devil ball into the sleeve for grasping and recovering the ball. The internal diameter within the flange portions 415 at the lower open end of the sleeve 402 is less than the diameter of the go-devil ball sufficiently that with some slight expansion of the finger portions of the sleeve defined by the slots 414 the ball will snap into the sleeve and be retained therein for lifting the ball from a well. A go-devil ball 279 is shown in phantom lines in FIG. 12B to illustrate the ball within the sleeve when being lifted from a well bore.

The go-devil safety valve 50 is reopened and also may be removed from a well bore by means of a combination reset and pulling tool 450 illustrated in FIGS. 8–8F. In FIG. 8 the tool 450 is shown preparatory to being latched into the upper end of a closed go-devil safety valve preliminary to the reopening of the safety valve. The tool 450 includes a body 451 having integral dependent circumferentially spaced locking fingers 452, a control finger collet 453, a handling core 454, prong 455 with a tip member 460, and shear blocks 461. The body 451 is internally threaded along an upper end portion which is secured with a tubular shaped head 462 having a reduced externally threaded portion 463 secured in the threaded upper end portion of the body. A downwardly facing shoulder 464 is provided on the head 462 limiting the extent to which the gland will thread into the body. The reduced threaded portion 463 of the gland has a pair of oppositely disposed shear pin holes 465 below the shoulder surface 464. The body 451 is provided with a plurality of downwardly opening slots 470 and is reduced in diameter along a lower end portion defining the locking fingers 452, each of which has an enlarged locking head 471. The locking fingers 452 and heads 471 are sized to enter the go-devil valve head 143 to engage the locking recess 146 in the head for resetting and also retrieving the go-devil valve. The control finger member 453 has a tubular upper portion **453*a* and dependent circumferentially spaced control fingers 453*b* spaced and sized to fit between the locking fingers 452. In the particular form of the tool shown there are three control fingers 453*b* and three locking fingers 452. Radial compression of the control fingers squeezes the locking fingers 452 and the heads 471 outwardly to expanded locking positions. The control fingers 453*b* are of a length which permits them to extend downwardly beyond the locking dog finger heads 471 when the parts are in the relative positions illustrated in FIG. 8**.

The prong 455 of the tool 450 has a head portion 480 comprising three circumferentially spaced radial guide wings **480*a* positioned and sized to fit in the slots 470 between the locking fingers 452 to orient the prong for locking the heads 471 in expanded position. The prong has an intermediate enlarged triangular locking section 481 having three flat surfaces 481*a* which provide sufficient clearance for the necessary inward movement of the control fingers 453*b* as required for radial compression of the fingers in expanding the heads 471. The prong section 481 has locking edges 481*b* which fit behind the dogs 471 to lock the dogs outwardly. The prong has an intermediate external annular boss 482 spaced below the enlarged section 481 and a lower end enlarged section 483 spaced below the boss 482. The lower end enlarged portion along with the tip 460 serves a choke or plugging function to preclude fluid flow through the go-devil safety valve when the reset tool is in operating position with the valve as illustrated in FIG. 8. The tubular prong tip 460 has an intermediate internal flange 460*a* to retain the tip on the prong. Additionally, the probe tip 460 has upwardly opening upper end slots 460*b* to receive the lower end portions of the control fingers 453*b* to provide sufficient clearance for the fingers to move downwardly and radially expand and contract during the operation of the reset and pulling tool. The prong tip has an upper external annular end flange 484 provided with a downwardly and inwardly sloping shoulder 484*a* for supporting the prong in the control tube 120 of the go-devil safety valve. The lower ends of the dog heads 471 may rest on the upper end edge of the prong tip 460 as illustrated in FIG. 8B**.

The handling core 454 of the tool 450 has an externally threaded upper end section 490 for securing the tool to a handling string to manipulate the tool in a well bore. The handling core has a reduced lower end portion 491 provided with a lower end external annular flange or foot 492 which loosely fits within the head end of the control finger member 453. The portion 491 of the core has a lower lock pin hole 493 for a lock pin used when the tool 450 is employed to retrieve the go-devil safety valve. The core reduced portion 491 has an upper shear pin hole 494 for a shear pin 495 used when the handling tool is employed for resetting or opening the go-devil safety valve in the well bore. A pair of identical shear blocks 461 in the form of cylindrical segments fitted on opposite sides of the core portion 491 are disposed within the body 451 around the core for connection with the shear pin 495 used when manipulating the reset and pulling tool to retain the handling core in the proper longitudinal relationship within the tool to perform the desired reset or valve opening function, as needed. The shear blocks 461 have upwardly facing external shoulder surfaces 501 which are engageable with the lower end of the head 462 to engage the head 462 after the outer end segments of the shear pin 495 are severed during the operation of the tool. As will be discussed in more detail hereinafter, the tool 450 may be used to reopen and latch or reset the go-devil safety valve in a well and also may be used to pull the safety valve from a well.

An alternate form of locking assembly 600 is illustrated in FIGS. 13 and 15 for releasably locking the go-devil safety valve 50 at a landing nipple within a well bore. The locking assembly 600 utilizes structure including locking dogs substantially identical to the Otis Control-A-Flo locking mandrels described and illustrated at page 3958 of the 1974–75 edition of the *Composite Catalog of Oilfield Services and Equipment*, supra, and may be handled by a Type X Otix running tool as described and illustrated at page 3987 of such publication. The running tool 600 has a fishing neck 601 threaded onto a locking dog expander sleeve 602 which slides within a locking dog retainer sleeve 603. A pair of radially expandable and contractible locking dogs 604 are supported around the expander sleeve connected with double-acting springs 605. The lower end of the key retainer sleeve is connected on a tubular packing mandrel 610 which is threaded into a lower body 611. A packing assembly 612 is supported around the packing mandrel at the upper end of the body 611. Spaced internal ring seals 613 are disposed in internal annular recesses within the packing mandrel for sealing with the stinger of the go-devil safety valve. Another ring seal 64 is positioned within an internal annular recess at the upper end of the body 611 sealing between the body and the packing mandrel 610 below the packing assembly 612. The packing mandrel 610 is reduced in diameter along a lower end portion 620 providing an external annular shoulder 621 at the upper end of the reduced portion. A plurality of shear pin holes 622 are located in the mandrel 610 above the shoulder 621 for connecting the locking assembly with a running tool, not shown. The body 611 is reduced in internal diameter along a lower portion 623 spaced below the lower end of the packing mandrel 610. The lower end of the reduced diameter portion 623 is defined by an internal annular flange 624 formed in the body 611. A split lock ring 625 is positioned within the body 611 below the lower end of the packing mandrel 610 extending downwardly into the reduced bore portion 623 of the body. The ring 625 has an upper portion 630 of uniform internal diameter and a lower portion 631 having a reduced downwardly and outwardly flaring internal diameter defining a sloping interanl annular shoulder surface 632. In the ring 625 the upper end of the lower portion 631 defines an internal annular upwardly facing shoulder 633. The external diameter of the lower packing mandrel portion 620 and the normal internal diameter of the ring portion 630 are substantially equal so that the tubular ring portion 630 may telescope upwardly over the mandrel end portion 620 until the internal ring shoulder 633 engages the lower end edge of the packing mandrel end portion 620. A shear ring 634 is positioned between the upper end edge of the ring 625 and the lower end edge of the packing mandrel 610 to releasably hold the ring 625 against upward movement within the reduced diameter portion 623 of the body 611.

A locking collet 635 is disposed within the body 611 below the ring 625 for connection with the lower end of a stinger on the go-devil safety valve to be locked by the packing assembly 600. The collet has circumferentially spaced upwardly and downwardly opening slots 636 so that the entire length of the collet is compressible and expandable. The collet has internal annular teeth 640 for engagement with the go-devil valve stinger. An external flange 641 is formed around the lower end of the collet to limit the upward movement of the collet within the body 611. The enlarged upper tapered end portion 642 of the collet 635 and the flange 641 are larger in diameter than the internal flange 624 of the body 611 so that once inserted into the body 611 to the position generally represented in FIG. 13 the collet will remain within the body and move longitudinally within the limits permitted by the spacing between the lower flange 641 and the upper enlarged portion 642 of the collet. The body 611 has a lower end portion 643 of reduced internal diameter defining an upwardly facing shoulder 644 within the body on which the lower end of the collet 635 rests when the collet is loose in the body as shown in FIG. 13.

FIG. 14 illustrates a modified go-devil valve stinger 73*a* for use with the locking assembly 600. The stinger 73*a* has a lower end portion 645 provided with a plurality of external annular teeth 645 which are engageable with the internal annular teeth 640 of the collet 635 in the locking assembly 600 for locking the stinger within the locking assembly to couple the go-devil valve with the locking assembly.

Unlike the locking assembly 51 the locking assembly 600 is run into a well bore independently of the go-devil valve and is generally used where wells are equipped with landing nipplies which are compatible with the locking keys 604 which are of a standard, universally used design. The locking assembly 600 is run on a suitable standard handling tool as previously discussed. After the assembly has been set in a well flow conductor at a landing nipple, the go-devil valve 50 is run into the well bore with the running tool 250. The modified form of the stinger 73*a* on the go-devil valve is telescoped downwardly into the bore of the locking assembly 600 until the lower end portion 645 of the stinger is driven into the collet 635. The collet expands as the stinger is stabbed down through the collet until the downwardly facing annular shoulder 71*a* on the stinger engages the upper end edge of the fishing neck 601 of the locking assembly 600. The toothed portion 645 of the stinger locks with the teeth 640 in the collet 635 coupling the stinger with the locking assembly 600. The go-devil valve is held by the stinger connected with the locking assembly 600 so long as upward forces on the stinger and go-devil valve do not exceed the shear strength of the ring 634.

In pulling the go-devil valve 50 from the locking assembly 600, the valve is engaged with the reset and pulling tool 450 in a manner yet to be described and is lifted upwardly applying an upward force through the stinger 73*a* to the collet 635. The collet is lifted with the upward tapered surface of the upper end portion 642 of the collet engaging the tapered shoulder surface 632 in the ring 625 lifting the ring against the shear ring 634. The ring 634 is sheared allowing the lock ring 625 to telescope upwardly over the reduced lower end portion 620 of the packing assembly body 610 to the position shown in FIG. 15. As the ring 625 moves upwardly out of the reduced bore portion 623 of the locking assembly body, the ring 625 is free to expand radially. The camming action of the tapered upper end portion 642 of the collet 635 expands the ring 625 so that the ring will telescope upwardly over the reduced body portion 620. When the ring 625 moves out of the reduced bore portion 623 so that the ring can expand, the expansion of the ring permits a corresponding expansion of the collet 635 so that the stinger end portion 645 is released, freeing the stinger from the locking assembly 600 so that the go-devil value can be pulled from the well bore.

In operation of the go-devil valve 50 using the locking assembly 51, the valve and locking assembly are run together in tandem along with a storm choke 53 in the relationship illustrated in FIGS. 1, 2A, and 2B. The go-devil valve is run latched open as shown in FIG. 2A so that fluid will freely flow through the valve as the valve and locking assembly are lowered in the well bore. The valve is coupled with the locking assembly by inserting the stinger 73 of the valve into the locking assembly to the position shown in FIG. 2B. The stinger is secured with the locking assembly by a pair of shear pins 182 which extend laterally across opposite sides of the stinger connecting the stinger with the body mandrel 200 of the locking assembly. The locking dogs 222 of the collet assembly 202 of the locking assembly 51 are in release positions as shown in FIG. 2B as the go-devil valve and locking assembly are to be inserted into the well bore. The running tool 250 is connected into the head 143 of the go-devil valve by assembling the running tool on the go-devil valve with the prong 264 of the running tool inserted into the collect 270 behind the collet fingers 271 for locking the running tool with the head 143. The shear pin 273 is inserted to lock the prong and the collet together so that the running tool will remain latched with the go-devil valve for installing the valve and locking assembly 51 in the well bore. The head 250 is placed on the collet and prong and secured with the screw 261. The storm choke 53 of suitable standard design is connected on the threaded lower end of the locking assembly 51.

The locking assembly 51 and go-devil valve 50 are lowered in the flow conductor 52 of a well bore until the selector keys 201 of the locking assembly reach a landing nipple **52*a* which has a recess profile corresponding to that of the selector keys at which time the keys expand into the landing nipple recess causing the locking assembly to stop at the landing nipple. For example, as shown in FIG. 5A, the selector keys are illustrated expanded into the selector recess 52*b* of the landing nipple 52*a*. With the locking assembly limited against downward movement by the selector keys at the landing nipple, further downward force applied through the running tool to the go-devil safety valve shears the internal segments 182*a* of the shear pins 182 releasing the stinger 73 of the go-devil valve to move downwardly in the bore of the locking assembly as shown in FIG. 5A. The downward force on the running tool 250 is transmitted to the upper end of the body member 72 of the go-devil valve. The force is transmitted downwardly through the body 70 of the go-devil valve and the lower body member 71 of the valve to the fishing neck 214 of the locking assembly 51. As the fishing neck 214 is driven downwardly, the cam surface 233, FIG. 2A, engages the upper cam surfaces 232*a* in the dogs 232 of the locking collet 202. The cam surface 233 expands the locking dogs driving them outwardly into the upper locking recess 52*c* of the landing nipple 52*a* thereby securing the locking assembly in the landing nipple. The lock portion 230 of the fishing neck moves behind the inner bosses of the locking dogs 232 to lock the dogs in the expanded positions in the landing nipple as illustrated in FIG. 5A. The fishing neck is driven downwardly in this fashion until the downwardly facing annular shoulder 235 engages the upper end of the collet 202**.

After securing the locking assembly 51 in the landing nipple **52*a* as above described, the running tool 250 is disengaged from the upper end of the go-devil valve by applying an upward force to the running tool. The upward force is transmitted through the shear pin 273 in the core portion 262 while upward movement is resisted by the collet 270 applying a shear force to the outer end portions of the shear pin 273. The upward movement is opposed by the collet 270 because it is engaged with the head member 143 of the go-devil valve which is coupled through the valve body and stinger of the valve to the locking assembly 51. The upward force tends to lift the go-devil valve which may slide upwardly a short distance until the upwardly facing shoulder surfaces 180*a*, FIG. 5A, engages the shear pins 182 which holds the go-devil stinger preventing further upward movement of the valve. The shear pin 273 in the tool 250 then shears along the outer end segments within the head of the collet 270 releasing the pulling tool head to lift the core 262 and prong 264 along with the skirt 254 upwardly relative to the locking collet 270 of the tool. When the prong 264 is raised above the locking dogs 272 the prong flange 263 picks up the collet and the dogs are then cammed inwardly sufficiently to release the running tool from the internal locking recess 146 of the head of the go-devil valve. The running tool 250 along with the handling string 251** are then pulled from the well bore.

After setting the open go-devil valve in the flow conductor as described, the go-devil ball 279 may be placed in the pocket chamber 291. The ball dropper is first cocked by positioning the piston 325 as in FIG. 9 and placing the washer 380 between the fingers 370 and 373. The go-devil ballis installed in the ball dropper by means of the tool 700 shown in FIG. 12A. The tool 700 is a tubular member having an internally threaded bore 701 at one end connected with a tube 702. The bore 701 has a side discharge opening 703. The tool 700 also has a side opening pocket 704 for retrieving the ball. The tool 700 is lowered through the wellhead until the outlet 701 is aligned with the pocket 291 of the ball dropper assembly. The go-devil ball is then dropped into the tube 702 supporting the handling tool and the ball falls through the tube into the tool 700 where the ball is deflected through the sloping exit 703 into the pocket 291 of the ball dropper. Should it be necessary to retrieve the ball from the ball dropper without dropping it through the well bore to the go-devil valve, the tool 700 may be oriented and vertically aligned to position the pocket 704 of the tool 700 opposite the ball dropper pocket 291. The ball dropper is then actuated to rotate the pusher 293 inwardly to eject the ball from the pocket 291 dropping it into the handling tool pocket 704 in which the ball is lifted from the well back upwardly through the valves 63 and 64.

With the go-devil ball 279 positioned in the ball dropper 62 and the go-devil safety valve 50 suitably landed and locked in the tubing string, the well is protected in accordance with the invention. The ball dropper is cocked for dropping the ball 273 to the go-devil safety valve for closing the safety valve responsive to whatever operating condition the ball dropper is set up to react to. As illustrated in FIG. 9 the ball droppr is held in a cocked condition by the heat-responsive washer 380. Should a fire break out in the vicinity of the wellhead which generates a high enough temperature at the ball dropper to melt the washer 380, the wedging effect of the washer against the latch finger 370 is removed. When the washer 380 melts, the force of the spring 353 on the cap 354 is applied through the pin 360 to the plunger 325 pulls the plunger toward the cap. The cam surface **371*a* on the latch finger catch 371 acting against the finger cam surface 375*a* deflects the finger 370 so that the catch 371 moves into the slot 373 releasing the finger and thereby allowing the spring 353 to pull the plunger 325 upwardly as seen in FIG. 9. As the plunger moves upwardly the link 324 rotates the crank 311 in a clockwise direction as viewed from the right end of the ball dropper assembly as seen in FIG. 9. The clockwise rotation of the crank turns the drive rod 304 which rotates the pusher 293 relative to the pin 295 which passes through the spiral slots 294 of the pusher. As the pusher is rotated clockwise relative to the pin, the pusher is driven inwardly engaging and pushing the ball 279 from the pocket 291 into the wellhead bore 283**.

The go-devil ball 279 drops downwardly in the tubing string 52 until it strikes the upper end of the go-devil valve head 143 seating in the upper end of the head as shown in FIG. 3. The windows 170 in the head 143 allow well fluids to deflect out of the head as the ball approaches the head for closing the valve against high flow rates. The head 143 of the go-devil valve is lightly supported by the spring 153 which is designed simply to support only the weight of the head to give the go-devil valve a very light trigger action. The impact of the ball on the go-devil valve head drives the head downwardly. As soon as the propping fingers 155 of the head 143 move below the upper ends of the slots 161 of the locking dogs 141 the force of the compressed spring 130 applied downwardly to the operator tube 120 causes a camming action between the lower end edge surfaces 160*a* on the lower ends of the dogs 141 acting against the surface 134 of the member 131 thereby camming the locking dogs 141 inwardly into the windows 142. As the lower end edges 160*a* of the locking dogs pass off of the locking surface 134 of the member 131, the operator tube 120 is released to move downwardly. The force of the compressed spring 130 pulls the piston downwardly and the ball valve pivot members 112 move downwardly with the piston rotating the ball valve 74 from the open position shown in FIG. 2A to the closed position illustrated in FIG. 3. The lower ends of the locking dogs 141 move downwardly with the lower end portion of the member 143 into the bore of the member 131 as shown in FIG. 3. Since the spring 153 of the go-devil valve supports the head member 143 so lightly that only the weight of the member is held up by the spring, and the spring 130 is quite strong, the closing action of the valve is similar to the operation of a gun having a very light trigger action. The go-devil valve thus snaps closed in response to the impact of the go-devil ball. With the valve closed as shown in FIG. 3, the well pressure below the ball valve cannot reopen the valve inasmuch as the upper valve seat member 75 cannot move upwardly as it engages the internal flange 103 of the valve body 70.

The go-devil valve can be reopened only by the positive action of the resetting and pulling tool 450, or by pumping downwardly into the well bore above the closed ball valve. Such pumping would only be used in an emergency when it is necessary to flow fluid downwardly through the valve. The pumping would not lift the valve operator tube 120 which is necessary in latching the valve open. Thus, normal opening of the valve is accomplished with the tool 450.

Preparatory to use of the tool 450, the go-devil ball 279 just be removed from the upper end of the valve to permit entry of the reset tool into the valve. For recovery of the ball the tool 400 is connected with a handling string and lowered into the well bore until the lower end of the tool collet 402 telescopes over the ball. The collet fingers of the retrieving tool expand so that the lower ends of the collet fingers including the flanges 415, see FIG. 12B, pass downwardly around the ball. As soon as the flanges 415 pass below the center of the ball the ball is snapped upwardly into the collet to the position shown in broken lines in FIG. 12. The ball is then lifted from the well bore with the tool 400.

With the go-devil removed from the well bore the tool 450 is assembled for opening the go-devil valve. In assembling the tool, the pulling pin is left out of the bore 493 while the shear pin 495 is installed, as shown in FIG. 8, through the lateral bore 494 in the core portion 491 to lock the tool core with the shear blocks 500 and with the tool head 462. The upper externally threaded portion 490 of the tool is connected into the lower end of a suitable handling string and the tool is lowered into the tubing string 52.

When the tool 450 reaches the go-devil safety valve 50 the probe tip 460 of the tool enters the head 143 of the safety valve passing downwardly into the bore of the valve coming to rest at the position shown in FIG. 8 as determined by the engagement of the tapered shoulder surface 484*a* on the head 484 of the probe tip with the tapered upper end internal surface 120*a* on the upper end of the operating tube 120 of the go-devil safely valve. As the tool 450 is lowered in the well bore into the safety valve, the locking dogs 452 and the control fingers 453*a* are in their normal relaxed straight condition intermeshed as illustrated with the three control fingers positioned between and extending slightly below the three spaced locking dogs 452. The lower ends of the control fingers normally hang below the locking dog heads 471. As the tool 450 passes downwardly into the go-devil safety valve the locking dog heads 471 along with the collet fingers 452 connected with the heads are cammed inwardly sufficiently for the locking dogs to enter the go-devil safety valve head member 143 and snap out into place in the locking recess 146 of the head member. The locking dog heads 471 are free to compress inwardly to enter the valve head since the prong 455 of the reset tool is sufficiently reduced in diameter below the prong locking section 481 to permit the necessary compression of the dog heads. When the reset tool is fully inserted into the go-devil valve the lower ends of the dog heads 471 rest on the upper end of the probe tip 460 which is engaged in the operating tube 120 of the go-devil safety valve so that further downward movement of the tip 460 and the dogs 471 is prevented. At this particular stage in the operation of the reset tool, the lower end edges of the control fingers 453*b* engage the upper tapered end surface 120*a* on the control tube 120 of the go-devil safety valve. It will be noted in FIG. 8 that the slots 460*b* in the tip 460 permit the control fingers to extend below the upper end of the prong tip 460 so that the lower ends of the control fingers may engage the upper end of the control tube 120 which is below the head recess 146 when the probe tip is seated in the control tube. Additional downward force is applied by the handling string to the reset tool 450 shearing off the outer ends of the pin 495 extending into the member 462 releasing the tool head and core 491 and the shear blocks 461 which remain pinned together to move downwardly in the head 462 and the body 451 on which the locking dogs 452 are formed. The lower ends of the shear blocks 461 then engage the upper end 453*d* of the control finger assembly driving the control fingers 453*b* downwardly relative to the locking dogs 452. The tapered lower end edges of the control fingers 453*b* are cammed inwardly by the upper end edge 120*a* of the piston 120 of the go-devil safety valve so that the fingers move downwardly into the bore of the piston 120 as shown in FIG. 8B. The inward camming of the control fingers drives the control fingers between the locking dogs 452 so that the dogs are expanded sufficiently for the prong 455 to drop downwardly positioning the triangular shaped section 481 of the prong behind the locking dog heads 471 so that the vertical edge surfaces 481*b* of the triangular section 481 on the prong props the collet heads 471 in the expanded positions to lock the dogs within the head 143 of the go-devil safety valve.

With the locking dogs 471 of the reset tool 450 propped outwardly by the prong 455, the handling string is then lifted upwardly raising the core 491 and the shear blocks 461 until the upper shoulder surface 501 on the shear blocks engages the lower end edge of the threaded section 463 on the tool head 462. The upward force is then transmitted to the body member 451 on which the locking dog fingers 452 are formed so that the fingers are lifted upwardly. The control fingers **453*b* and the prong 451 remain in the downward positions holding the locking dog heads 471 locked with the head of the go-devil valve 143. The upward force is thus applied through the locking dog heads 471 to the go-devil valve head 143. The upward force on the member 143 is transmitted to the lower ends of the locking dogs 141 of the go-devil safety valve since the lower ends of the dogs are trapped between the outer surface of the operator tube 120 and the bore surface of the member 131. Thus, the upward force on the member 143 lifts the dogs 141. The upper ends of the dogs 141 engage the control piston 120 which is raised compressing the spring 130 and lifting the valve pivot members 112 which rotate the ball valve 74 back to the open position. The presence of the prong 455 and the prong tip 460 in the go-devil valve bore essentially plugs the valve bore as the ball valve is opened so that no upward pressure surge occurs when the go-devil valve is reopened. As soon as the dogs 141 are lifted sufficiently that the lower end edges 160*a* on the dogs are above the locking surface 134 on the member 131, the lower ends of the dogs are cammed outwardly into engagement with the surface 134 while the propping finger 155 behind each dog on the member 143 moves behind the dog to lock the dog outwardly at the position of FIG. 2A. Thereafter, the downward force of the compressed spring 130 urges the lower ends of the dogs tightly against the locking surface 134 on the member 131 and with the propping fingers 155 behind the dogs the go-devil safety valve remains locked open until once again the head member 143** is driven downwardly by a force such as that delivered by the go-devil ball.

After the go-devil safety valve is fully reopened and latched as described, the running tool 450 is disengaged from the valve and retrieved to the surface. Upward force is applied to the running string tending to lift the core member 454. When the safety valve was returned to the open position the head member 143 was lifted back to the position shown in FIG. 2A at which it is at an upper end location held by the internal flange 162 of the member 72. The upward force to the reset tool 450 applied through the shear pin 496 shears the pin along the boundary between the core 491 and the shear blocks 461 so that the core is released to move upwardly. The core is lifted upwardly with the core flange 492 engaging the internal flange **453*c* at the upper end of the locking finger member 453 lifting the locking fingers 453*b* from between the locking dogs 471 and raising the prong 455 so that the locking corner edges 481*b* of the prong are lifted from behind the locking dogs so that they may be compressed inwardly to release the tool 450 from the head of the go-devil safety valve. With the locking dogs 471** so released from the safety valve, the reset and pulling tool is retrieved from the well bore.

In the event that it is desired to use the tool 450 for retrieving the go-devil safety valve from the wall rather than only opening and latching the go-devil safety valve, the tool 450 is run into the well with a locking pin 496 in place in the bore 493 to lock the lower ends of the shear blocks 461 with the core 491 by means of a pin having much greater strength than the shear pin 495. The basic function of adding the additional pin between the shear blocks and the core is to prevent the tool 450 from going through the last phase described above wherein the core is released from the shear blocks to permit disengagement of the tool 450 from the safety valve. With the tool 450 so equipped, it is run into the valve in the previously described manner, engaged with the go-devil safety valve, and operated through the steps required for resetting or opening the safety valve. The size shear pins 182 usually used require heavy jarring to separate the safety valve 50 from the locking assembly 51. If the ball valve 74 were opened and closed with each blow of the jars, the valve assembly would be damaged. Thus, it is necessary that the valve be reopened and latched while jarring to release the valve from the locking assembly. Thus, after the tool 450 is operated through the steps of driving it downwardly to shear the outer end segments of the shear pin 495 so that the control finger member is driven downwardly along with the prong to lock the reset tool with the safety valve after which the valve is opened, the tool 450 is thereafter lifted upwardly raising the core 491 and he shear blocks 461 back to upper end positions. The core and shear blocks are lifted until the shear block flange surfaces 501 engage the lower end of the threaded portion 463 of the head 462 applying an upward force to the locking dogs 452. With the additional pin 496 connecting the shear blocks and the core, the core cannot be released from the shear blocks, and as the upward force is applied, the reset and pulling tool remains locked with the go-devil safety valve so that the safety valve is lifted upwardly by a force tending to pull the safety valve out of the lock assembly 51. The safety valve is pulled upwardly relative to the lock assembly so that the stringer 73 is lifted in the lock assembly. As seen in FIG. 5C the stinger is lifted until the upwardly facing flange **180*a* on the stinger engages the outer portions of the shear pins 182 which still remain from the previous partial shearing of the pins required in initially locking the safety valve with the locking assembly. The shoulder 180*a* shears an intermediate segment 182*b* of the pins 182 releasing the stinger to be pulled upwardly from the locking assembly. The tool 450 and the go-devil safety valve 5 are removed from the well bore with the handling string. The locking assembly 51 remains in the landing nipple and may thereafter be retrieved by engaging a suitable standard pulling tool, not shown, with the fishing neck recess 215 of the tool to pull the fishing neck 214 upwardly until the locking surface 230 of the fishing neck 214 has been lifted from within the locking collet 202** so that the collet fingers may compress inwardly to release the locking assembly from the landing nipple.

Thus, the well safety valve system which has been described and illustrated provides means, such as with a storm choke, to shut-in a well in response to an excessive flow rate which may cause rupture of the wellhead equipment or the flow conductor in the well bore. Additionally, the well safety system, in accordance with the invention, provides means for shutting in a well in response to conditions independent of flow rate, such as fire at the wellhead, which will activate the ball dropper depositing the go-devil ball in the well bore so that the go-devil savety valve closes responsive to the impact of the ball to shut in the well. Thus, a well may be shut-in even though no leakage is occurring or when the well is leaking at such a slow rate that the storm choke will not close. The ball type go-devil has been found to be capable of closing the valve against rather substantial flow rates. A particularly effective form of ball is made of Kinnertium-2 which has a specific gravity of 18.5, slightly more than twice as heavy as a similar steel go-devil ball tested. Such a more dense ball has reliably closed the valve against gas flow rates as high as 3.98 MMCFPD. In the particular fire responsive ball dropper illustrated and described, a washer has been designed to melt at 203° F. so that the only condition necessary to activate the ball dropper is a temperature of that valve around the ball dropper which will melt the washer. It will be apparent that other safety systems associated with the wellhead and related apparatus may be connected with the ball dropper to latch and release the operating piston of the dropper so that the safety system may be operated in response to operating condition changes other than fire alone.

The go-devil type well safety valve described and illustrated is supported in a well bore by a locking assembly which is located below the safety valve so that the upper end of the safety valve is readily accessible from above the valve. The safety valve includes an operating and latching assembly for opening and closing the valve and for latching it open. The latching assembly has an operator portion located at the upper end of the valve by such means as the impact from a go-devil dropped to the valve along the well bore from above the valve.

The complete safety system described and illustrated includes the go-devil type safety valve, the locking assembly located below the valve and adapted to be releasably connected with the valve and with a landing nipple in a well flow conductor, a go-devil for actuating the valve by impact against the upper end of the valve, an assembly for storing and dropping the go-devil into the well flow conductor, special tools for introducing and retrieving the go-devil, and a handling tool used to reopen the go-devil safety valve in the well and to retrieve the valve from the well bore. The go-devil storage and dropping assembly is operated by a rod which requires only rotation so that the assembly is sealed for maximum pressure tight integrity of the wellhead in which the assembly is connected.

The go-devil safety valve is initially installed in a well bore by connecting it with the special locking assembly and running the safety valve and locking assembly as a unit into a well bore locking the unit at a landing nipple provided along the flow conductor in the well bore. The safety valve is normally run latched open. A go-devil is then introduced into the assembly used for storing the go-devil and dropping it in the well bore. The go-devil handling assembly is operated responsive to various well conditions such as temperature. When the go-devil is dropped to the safety valve, the impact of the go-devil on the operator member of the safety valve latching assembly causes the safety valve to close. The go-devil may then be retrieved from the top of the safety valve, and the reset and pulling tool introduced in the well bore to engage, reopen, and latch the go-devil safety valve open. The reset tool also may be used to disengage the go-devil safety valve from the locking assembly and pull the safety valve from the well bore. In removing the safety valve from the well bore it is disengaged from the locking assembly which is thereafter retrieved by use of a conventional wireline type pulling tool.

If desired, the well bore may be treated below the go-devil safety valve by pumping fluid downwardly in the flow conductor above the valve to open the ball valve 74. The fluid pressure above the closed ball valve is increased until the pressure valve exceeds that below the valve at which time the pressure will force the ball valve downwardly against the downwardly telescoping lower valve seat 82. The valve seat is forced downwardly compressing the spring 92 and as the ball is depressed the pivot members 112 remain at fixed positions so that the ball valve 74 is rotated as it moves downwardly against the lower seat. The rotation of the ball turns the valve to an open position. So long as pumping continues the valve will remain open. The valve is closed by lowering the pumping pressure until the pressure across the ball is equalized. After such pressure equalization, the lower seat 82 is lifted by the compressed spring 92 returning the ball to the closed position of FIG. 3. The reason that the pivot members 112 remain at the lower end positions during this procedure is that the spring 130 holds the operator tube 120 at the lower end position and the only way the operator tube can be lifted against the spring is by applying a mechanical force to the head 143 for pulling the piston back upwardly as described in connection with the resetting and opening procedure previously described. Since the pivot members 112 hang from the control piston they must remain in the lower end position until mechanically lifted.

What is claimed is:

1. A go-devil support and discharge assembly for holding a go-devil member and discharging said member into a well flow conductor for closing a well safety valve operable responsive to an impact by said go-devil member, said assembly comprising: a main body having flanges for connection of said body into a wellhead and having a bore communicating with the bore through said wellhead, said main body being further provided with a side pocket chamber opening through a side of said body and intersecting said bore of said body at the inward end of said side pocket chamber, said side pocket member having a longitudinal bore provided with an enlarged open inward end for supporting a go-devil member adjacent to said body bore and said bore of said side pocket member having a reduced outward portion opening through the other end of said side pocket member; a tubular go-devil pusher supported in said reduced bore portion of said side pocket member and having an inward end engageable with a go-devil member in said side pocket member for pushing said go-devil member from said side pocket member into said bore of said body to drop downwardly in said well head, said pusher having a helical slot for receiving a fixed lateral pin secured at opposite ends with said side pocket member to guide said pusher helically inwardly to discharge said go-devil when said pusher is rotated in said side pocket member relative to said pin; a fixed lateral pin secured across said reduced bore portion of said side pocket member through said helical slot of said pusher; an operating plunger body secured with said main body and having a first bore communicating with said reduced bore portion of said side pocket member, said plunger body having a second bore extending substantially perpendicular to said first bore in said body to accommodate an operating plunger; a rotatable rod secured in said first bore of said plunger body extending into and connected with said pusher for rotating said pusher; a seal assembly in said bore ofsaid plunger body around said shaft to seal against leakage of well fluids outwardly along said rod; a crank arm connected with an outward end of said rod and rotatably supported in said first bore of said plunger body for turning said rod to operate said pusher; a longitudinally movable plunger in said second bore of said plunger body; a link pin between said plunger and said crank arm for rotating said crank arm responsive to longitudinal movement of said plunger; biasing means between a first end of said plunger and said plunger body for biasing said plunger in a direction to rotate said rod to turn said pusher for moving said pusher inwardly to discharge said go-devil from said pocket member; and latch means between said plunger body and the second opposite end of said plunger for releasably latching said plunger at a position at which said pusher is retracted outwardly for holding a go-devil within said pocket member, said latch assembly being operable responsive to a predetermined operating condition at said piston assembly.

2. An assembly in accordance with claim 1 including a latch finger along said second end of said plunger, said latch finger having a latch surface thereon said plunger body having a recess through which said latch finger extends and having a latch surface along said recess engageable by said latch surface on said latch finger, said latch finger being adapted to be held at a latching position engaging said latching surface of said plunger body by means adapted to function responsive to temperature changes at said well head.

3. A go-devil storage and discharge assembly for use in a well system including a go-devil actuated well safety valve, said storage and discharge assembly comprising: a body having a first bore communicating with the bore through said flow conductor when said body is connected with said flow conductor and said body having a second bore communicating with said first bore for housing a go-devil; a go-devil pusher in said second bore adapted to move in said second bore in a direction to push a go-devil from said second bore into said first bore; means connected between said pusher and said body for moving said pusher linearly in response to rotation of said pusher; an operating rod extending into said second bore and connected with said pusher for actuating said pusher responsive to a rotational motion only of said operating rod; and means supported on said body and coupled with said operating rod for rotating said operating rod responsive to a predetermined well system operating condition.

4. A go-devil storage and discharge assembly in accordance with claim 3 including a one way seal assembly between said body and said operating rod allowing leakage inwardly to said second bore of said body while precluding leakage outwardly from said bore along said rod.

5. A go-devil storage and handling assembly in accordance with claim 4 including a spring biased plunger assembly; crank means connecting said plunger assembly with said operating rod; and means for releasably holding said plunger assembly at position at which said pusher is retracted in said second bore of said body when storing a go-devil in said second bore.

* * * * *